US008311665B2

(12) United States Patent
Uesaka et al.

(10) Patent No.: US 8,311,665 B2
(45) Date of Patent: Nov. 13, 2012

(54) METHOD FOR HANDLING PAPER SHEETS

(75) Inventors: Sadaaki Uesaka, Hyogo-Ken (JP); Hajime Morino, Kasukabe (JP); Keishi Kobayashi, Siso (JP)

(73) Assignee: Glory Ltd., Himeji-Shi, Hyogo-Ken (JP)

( * ) Notice: Subject to any disclaimer, the term of this patent is extended or adjusted under 35 U.S.C. 154(b) by 119 days.

(21) Appl. No.: 12/737,509

(22) PCT Filed: Jul. 22, 2008

(86) PCT No.: PCT/JP2008/063121

§ 371 (c)(1),
(2), (4) Date: Jan. 19, 2011

(87) PCT Pub. No.: WO2010/010606

PCT Pub. Date: Jan. 28, 2010

(65) Prior Publication Data

US 2011/0156334 A1 Jun. 30, 2011

(51) Int. Cl.
*G07D 9/00* (2006.01)

(52) U.S. Cl. ..... 700/221; 270/52.02; 270/52.01; 194/206; 209/534

(58) Field of Classification Search ..... 270/52.01, 270/52.02, 58.01; 194/205, 206, 207, 210; 700/221; 209/534
See application file for complete search history.

(56) References Cited

U.S. PATENT DOCUMENTS 5,104,105 A * 4/1992 Cote et al. ..... 270/1.02
5,575,463 A * 11/1996 Parkander ..... 270/52.02
5,917,930 A * 6/1999 Kayani et al. ..... 382/135
6,519,503 B2 * 2/2003 Paterson et al. ..... 700/226
7,133,741 B2 * 11/2006 Matzig et al. ..... 700/221
7,422,117 B2 * 9/2008 Myatt ..... 209/534
7,849,994 B2 * 12/2010 Klein et al. ..... 194/206

FOREIGN PATENT DOCUMENTS

JP 2007-280118 10/2007
JP 2008-050053 3/2008
JP 2008-084169 4/2008

* cited by examiner

*Primary Examiner* — Patrick MacKey

(74) *Attorney, Agent, or Firm* — Renner, Kenner, Greive, Bobak, Taylor & Weber

(57) ABSTRACT

When handling paper sheets, the paper sheet present at the uppermost or lowest part of each batch of the paper sheets is assigned as a designated paper sheet, and then intrinsic information on this designated paper sheet is associated with transaction information corresponding to the batch of the paper sheets. Thereafter, a plurality of batches of the paper sheets are stacked, one on another, in a certain number corresponding to transactions, while the intrinsic information on each designated paper sheet is already associated with the corresponding transaction information. Then, such stacked batches of the paper sheets are handled, collectively, by a paper sheet handling system. Thereafter, each recognition result on the plurality of batches of the paper sheets, respectively handled by the paper sheet handling system, is separated by utilizing each designated paper sheet. As such, information on the association between each recognition result on the paper sheets and the transaction information can be obtained.

17 Claims, 12 Drawing Sheets

METHOD FOR HANDLING PAPER SHEETS

FIELD OF THE INVENTION

The present invention relates to a method for handling paper sheets, which can collectively handle a plurality of batches of the paper sheets, respectively stacked, one on another, in a certain number corresponding to transactions, by a paper sheet handling system. In particular, this invention relates to the method for handling the paper sheets, which can readily obtain information on association between each recognition result on the paper sheets and the transaction information.

BACKGROUND OF THE INVENTION

For collectively handling the plurality of batches of the paper sheets, including banknotes, bar-code tickets and the like, by the paper sheet handling system, one method, which is adapted for separating the batches of the paper sheets, for each transaction, has been known. More specifically, in this method, a separator member, such as a header card or the like, is placed at an uppermost or lowest part of each batch of the paper sheets, so that the batches of the paper sheets can be separated, one from another, by means of such separator members. Namely, by separating the batches of the paper sheets, one from another, by using each corresponding separator member, the information on the association between each recognition result on the paper sheets and the transaction information can be obtained. As used herein, "the transaction information" means ID information on each slot machine installed in a casino, ID information on each cassette detachably attached to the slot machine, information on each customer (e.g., each customer code) provided for identifying each person depositing money, a bank-account number of each customer, or the like.

For instance, JP2000-503956T discloses one method for handling currency, such as banknotes, bar-code tickets and the like, by a currency handling machine. In this method, separator cards are used for separating a plurality of batches of the currency, respectively fed into the currency handling machine. Namely, use of such separator cards enables successive handling of batches of currency without stopping handling operations between respective batches. In this case, each separator card can serve as a means for securely separating each adjacent pair of batches of the currency, one from another.

DISCLOSURE OF THE INVENTION

However, for the above conventional method for handling the paper sheets by using the separator members, such as the header cards, separator cards and the like, the production cost should be unduly increased for making such dedicated separator members. Besides, such dedicated separator members should be respectively provided to be fit for each handling mode for the paper sheets, thus rendering the maintenance of the handling system rather complicated. Furthermore, such separator members are always used in the paper sheet handling system, and thus left in a reject unit, even after all of the paper sheets for the transactions are once handled in a normal state. Therefore, there is a need for further handling such used separator members, such as removing them from the reject unit or the like, each time the handling operation for the paper sheets is ended.

The present invention was made in light of the above problem, and therefore it is an object of this invention to provide the method for handling the paper sheets, which can separate the recognition result on the plurality of paper sheets, respectively handled by the paper sheet handling system, one from another, while each recognition result on the paper sheets is associated with each transaction information, without a need for providing any dedicated separator members, such as the header cards, separator cards and the like. Thus, this method can eliminate the production cost required for the dedicated separator members, as well as can eliminate the need for providing such dedicated separator members to be fit for each handling mode for the paper sheets. Therefore, it is possible to readily obtain the information on the association between each recognition result on the paper sheets and the transaction information, while eliminating the need for further handling the used separator members after each handling operation for the paper sheets is ended.

The present invention is a method for handling paper sheets, comprising: assigning a paper sheet present at the uppermost or lowest part of each batch of the paper sheets, as a designated paper sheet, while associating intrinsic information on the designated paper sheet with transaction information corresponding to the batch of the paper sheets; stacking a plurality of batches of the paper sheets, one on another, in a number corresponding to transactions, the transaction information being associated with the intrinsic information on each designated paper sheet; handling the stacked batches of the paper sheets, collectively, by using a paper sheet handling system; and separating each recognition result on the plurality of batches of the paper sheets, respectively handled by the paper sheet handling system, by each designated paper sheet, thereby to obtain information on the association between each recognition result on the paper sheets and the transaction information.

In the method for handling paper sheets of the present invention, it is preferable that when collectively handling the plurality of stacked batches of the paper sheets by the paper sheet handling system, the designated paper sheet of each batch of the paper sheets is first handled in the handling operation for the batch of the paper sheets, and when a certain paper sheet is handled by the paper sheet handling system, the transaction information, with which the intrinsic information on the designated paper sheet that has been handled by the paper sheet handling system before the certain paper sheet is associated, is judged to be associated with the certain paper sheet. In this case, it is further preferable that when collectively handling the plurality of stacked batches of the paper sheets by the paper sheet handling system, the designated paper sheets of the respective batches of the paper sheets are respectively fed to a reject unit of the paper sheet handling system. It is also further preferable that once the paper sheets are handled by the paper sheet handling system, a rejected paper sheet and designated paper sheets, respectively stacked one on another in the reject unit, are collectively handled again by the paper sheet handling system, while the order of stacking such paper sheets is kept, and then the designated paper sheets and the paper sheet that is capable of being handled during this handling operation are stored in a stacker of the paper sheet handling system, while the rejected paper sheet that is not capable of being handled is fed to the reject unit, and then the handling operation for the paper sheets, by the paper sheet handling system, is stopped.

In the method for handling paper sheets of the present invention, when collectively handling the plurality of stacked batches of the paper sheets by the paper sheet handling system, the designated paper sheet of each batch of the paper sheets is last handled in the handling operation for the batch of the paper sheets, and when a certain paper sheet is handled by the paper sheet handling system, the transaction information, with which the intrinsic information on the designated paper sheet that is handled by the paper sheet handling system after the certain paper sheet is associated, is judged to be associated with the certain paper sheet. In this case, it is further preferable that when collectively handling the plurality of stacked batches of the paper sheets by using the paper sheet handling system, when some paper sheet, determined as an abnormal paper sheet, is included in the paper sheets respectively fed to the paper sheet handling system, such paper sheet, determined as the abnormal paper sheet, and the designated paper sheet that is handled after such paper sheet are respectively fed to the reject unit of the paper sheet handling system, while the other designated paper sheet is stored in the stacker of the paper sheet handling system. It is also further preferable that once the paper sheets are handled by the paper sheet handling system, the rejected paper sheet and designated paper sheets, respectively stacked one on another in the reject unit, are collectively handled again by the paper sheet handling system, while the order of stacking such paper sheets is kept, and then the designated paper sheets and the paper sheet that is capable of being handled during this handling operation are stored in the stacker of the paper sheet handling system, while the rejected paper sheet that is not capable of being handled is fed to the reject unit, and then the handling operation for the paper sheets, by the paper sheet handling system, is stopped, once the designated paper sheet to be handled after such rejected paper sheet is handled.

In the method for handling paper sheets of the present invention, the batches of the paper sheets consist of batches of the banknotes, and the banknote present at the uppermost or lowest part of each batch of the banknotes is assigned as a designated banknote, and the serial number of the designated banknote is associated with the transaction information corresponding to the batch of the banknotes, when associating the intrinsic information on the designated banknote with the transaction information. In this case, it is further preferable that when associating the serial number of the designated banknote with the transaction information, the serial number of the designated banknote and the transaction information are respectively inputted to the paper sheet handling system, and then a control unit of the paper sheet handling system associates the inputted serial number of the designated banknote with the inputted transaction information. It is also further preferable that the paper sheet handling system includes a banknote handling machine, and the banknote handling machine is adapted for taking the banknotes, one by one, from the exterior to the interior thereof, recognizing each banknote taken therein, and then storing the banknote, determined as a normal banknote, in a stacker, while feeding the banknote, each determined as an abnormal banknote, to a reject unit.

In the method for handling paper sheets of the present invention, the batches of the paper sheets consist of batches of the bar-code tickets, the bar-code ticket present at the uppermost or lowest part of each batch of the bar-code tickets is assigned as a designated bar-code ticket, and the bar-code information on this designated bar-code ticket is read and associated with the transaction information corresponding to the batch of the bar-code tickets, when associating the intrinsic information on the designated bar-code ticket with the transaction information. In this case, it is further preferable that when associating the bar-code information on the designated bar-code ticket with the transaction information, the bar-code information on the designated bar-code ticket and the transaction information are respectively inputted to the paper sheet handling system, and then the control unit of the paper sheet handling system associates the inputted bar-code information on the designated bar-code ticket with the inputted transaction information. It is also further preferable that the paper sheet handling system includes a bar-code ticket handling machine, and the bar-code ticket handling machine is adapted for taking the bar-code tickets, one by one, from the exterior to the interior thereof, reading the bar-code information on each bar-code ticket taken therein, and then storing the bar-code ticket, determined as a normal bar-code ticket, in a stacker, while feeding the bar-code ticket, determined as an abnormal bar-code ticket, to a reject unit.

In the method for handling paper sheets of the present invention, the batches of the paper sheets include both the banknotes and bar-code tickets, in a mixed state, one bar-code ticket included in each batch of the paper sheets is moved to the uppermost or lowest part of the batch of the paper sheets, before the plurality of the batches of the paper sheets are stacked, one on another, in the number corresponding to the transactions, and then the bar-code ticket moved to the uppermost or lowest part is assigned as the designated bar-code ticket, and the bar-code information on the designated bar-code ticket of each batch of the paper sheets is read, and then the so-read bar-code information is associated with the transaction information corresponding to the batch of the paper sheets. In this case, it is preferable that the paper sheet handling system includes a paper sheet handling machine configured for handling both the banknotes and bar-code tickets; the paper sheet handling machine is adapted for taking the paper sheets, one by one, from the exterior to the interior thereof, recognizing each paper sheet taken therein, and then storing the banknote, determined as the normal banknote, in one stacker, and storing the bar-code ticket, other than the designated bar-code ticket, in another stacker, as well as feeding the banknote, determined as the abnormal banknote, to the reject unit, while feeding the bar-code ticket, determined as the abnormal bar-code ticket, and the designated bar-code ticket to the reject unit.

Alternatively, the paper sheet handling system includes both the banknote handling machine and bar-code ticket handling machine, the banknote handling machine is adapted for taking the paper sheets, one by one, from the exterior to the interior thereof, recognizing each paper sheet taken therein, and then storing the banknote, determined as the normal banknote, in the stacker, while feeding the banknote, determined as the abnormal banknote, to the reject unit, as well as feeding the bar-code ticket to the reject unit, the bar-code ticket handling machine is adapted for taking the paper sheets, one by one, from the exterior to the interior thereof, reading the bar-code information on each bar-code ticket, among the paper sheets taken therein, and then storing the bar-code ticket, determined as the normal bar-code ticket, in the stacker, while feeding the bar-code ticket, determined as the abnormal bar-code ticket, and the designated bar-code ticket to the reject unit, as well as feeding the banknote to the reject unit, and when collectively handling the plurality of stacked batches of the paper sheets by the paper sheet handling system, the plurality of batches of the paper sheets are first handled collectively by the bar-code ticket handling machine, and then the paper sheets respectively fed to the reject unit of the bar-code ticket handling machine are handled collectively by the banknote handling machine.

Alternatively, the paper sheet handling system includes both the banknote handling machine and bar-code ticket handling machine, the banknote handling machine is adapted for taking the paper sheets, one by one, from the exterior to the interior thereof, recognizing each paper sheet taken therein, and then storing the banknote, determined as the normal banknote, in the stacker, while feeding the banknote, determined as the abnormal banknote, to the reject unit, as well as feeding the bar-code ticket to the reject unit, the bar-code ticket handling machine is adapted for taking the paper sheets, one by one, from the exterior to the interior thereof, reading the bar-code information on each bar-code ticket, among the paper sheets taken therein, and then storing the bar-code ticket, determined as the normal bar-code ticket, in the stacker, while feeding the bar-code ticket, determined as the abnormal bar-code ticket, and the designated bar-code ticket to the reject unit, as well as feeding the banknote to the reject unit, and when collectively handling the plurality of stacked batches of the paper sheets by the paper sheet handling system, the plurality of batches of the paper sheets are first handled collectively by the banknote handling machine, and then the paper sheets respectively fed to the reject unit of the banknote handling machine are handled collectively by the bar-code ticket handling machine.

DETAILED DESCRIPTION OF THE INVENTION

Hereinafter, one embodiment of the present invention will be described with reference to the drawings. First, referring to FIGS. 1 through 3, the general construction of the paper sheet handling system used in the method for handling the paper sheets related to the embodiment of the present invention will be described. Of these drawings, FIG. 1 schematically shows the general construction of the paper sheet handling system related to this embodiment, FIG. 2 schematically illustrates the banknote handling machine provided in the paper sheet handling system shown in FIG. 1, and FIG. 3 schematically illustrates the bar-code ticket handling machine provided in the paper sheet handling system shown in FIG. 1.

Figure 2:
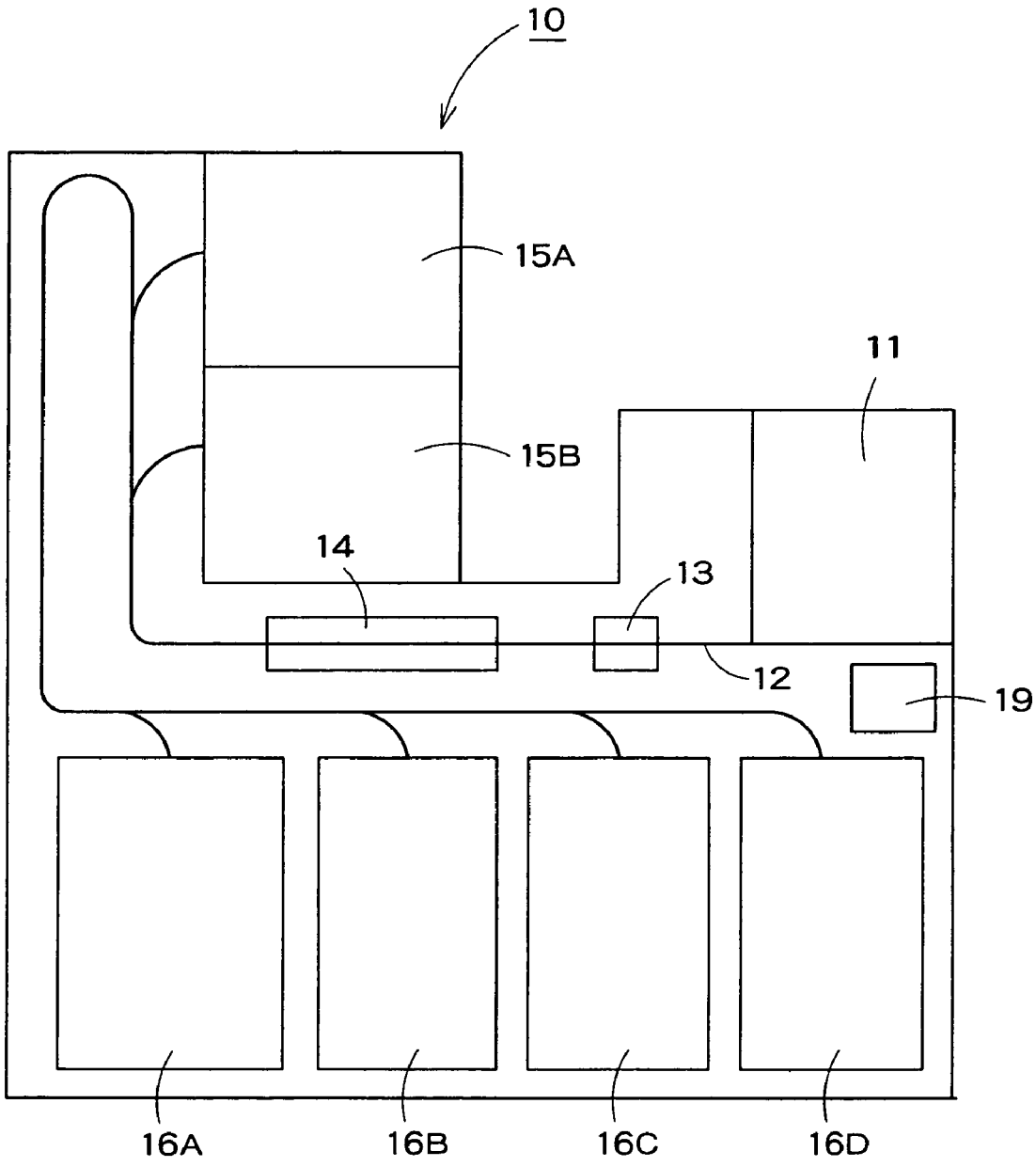
FIG. 2 is a diagram schematically illustrating a banknote handling machine provided in the paper sheet handling system shown in FIG. 1.
Figure 3:
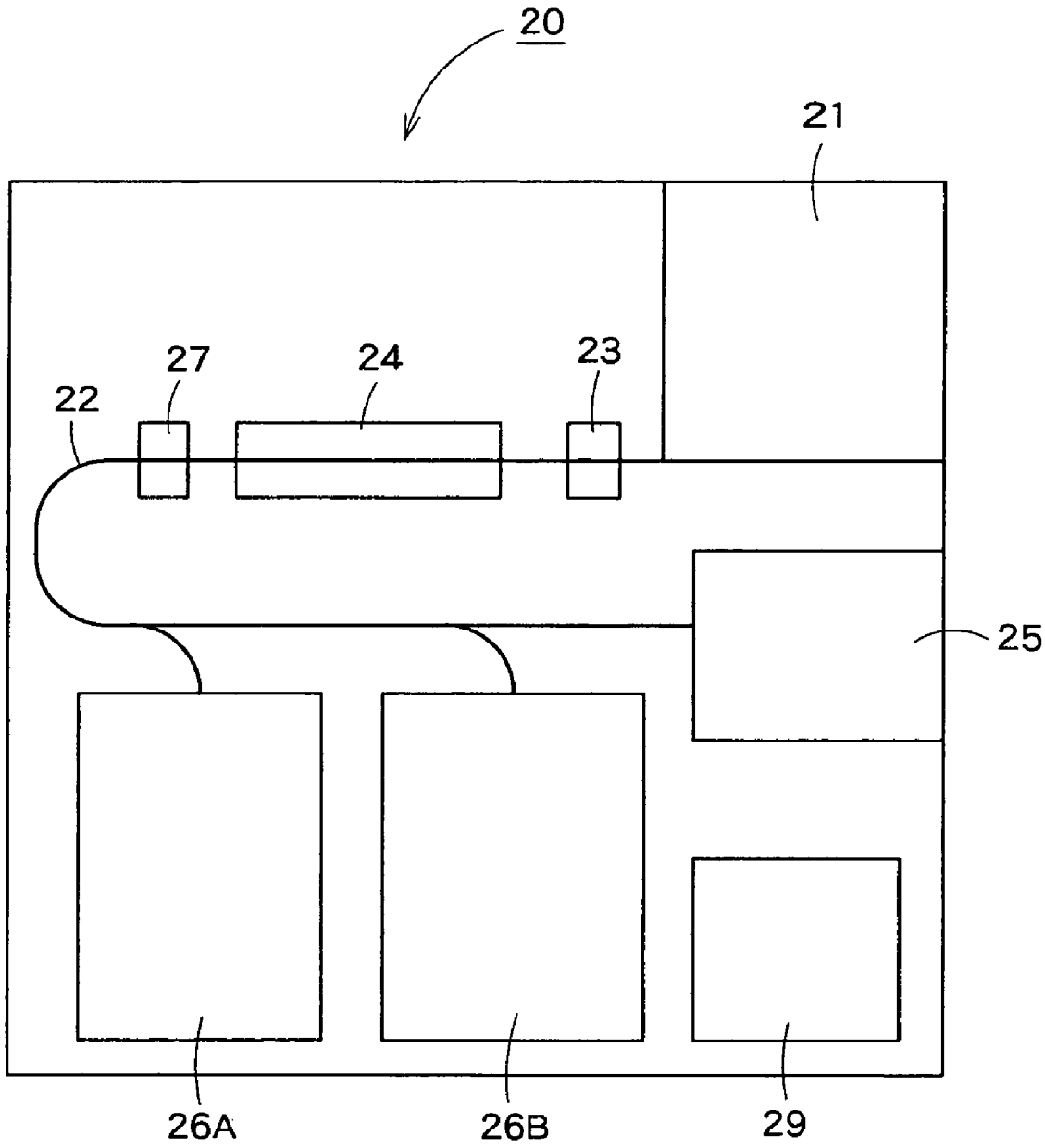
FIG. 3 is a diagram schematically illustrating a bar-code ticket handling machine provided in the paper sheet handling system shown in FIG. 1.

The paper sheet handling system used in the method for handling the paper sheets related to this embodiment includes the paper sheet handling machine as shown in FIG. 2 and the bar-code ticket handling machine as shown in FIG. 3. In this case, depending on an object or objects to be handled in the method for handling the paper sheets related to this embodiment, only one of the banknote handling machine as shown in FIG. 2 and the bar-code ticket handling machine as shown in FIG. 3 may be used.

Figure 1:
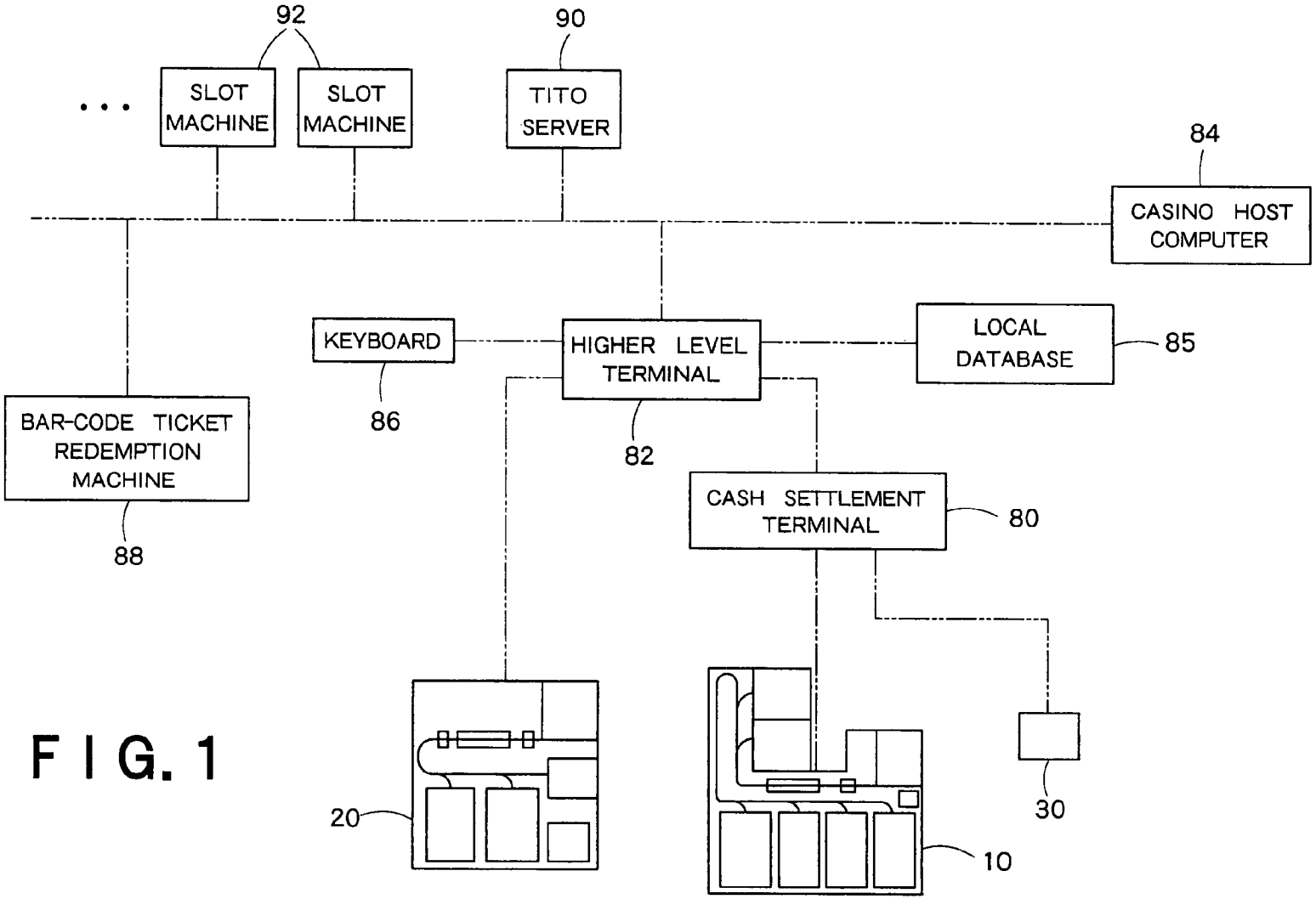
FIG. 1 schematically shows general construction of the paper sheet handling system related to one embodiment of the present invention.

As shown in FIG. 1, the paper sheet handling system includes the banknote handling machine 10 adapted for taking the paper sheets, one by one, from the exterior to the interior thereof, and then recognizing each banknote, among the paper sheets taken therein, and further includes the bar-code ticket handling machine 20 adapted for taking the paper sheets, one by one, from the exterior to the interior thereof, and then reading bar-code information on each bar-code ticket, among the paper sheets taken therein, while obtaining an image of the bar-code ticket.

A cash settlement terminal 80 is connected, for communication, to the banknote handling machine 10. Further, a handy bar-code scanner 30 is connected, for communication, to the cash settlement terminal 80. In addition, a higher level terminal 82 is provided in the paper sheet handling system, while being connected, for communication, to both the cash settlement terminal 80 and bar-code ticket handling machine 20. This higher level terminal 82 is provided with a local database 85 and a keyboard 86. Further, a casino host computer 84 is provided in the paper sheet handling system, and the higher level terminal 82 is connected, for communication, with this casino host computer 84. In this case, a bar-code ticket redemption machine 88, a TITO (Ticket In Ticket Out) server 90, a plurality of slot machines 92, and the like are also connected, respectively, for communication, to the casino host computer 84. Hereinafter, each component of this paper sheet handling system will be described in detail with reference to FIGS. 1 through 3.

First, referring to FIG. 2, the banknote handling machine 10 will be described in detail. This banknote handling machine 10 can serve to take the paper sheets, one by one, from the exterior to the interior thereof, and then recognize each banknote, among the paper sheets taken therein.

As shown in FIG. 2, the banknote handling machine 10 includes a take-in unit 11, a transport unit 12, a transport-condition detection unit 13, a recognition unit 14, two reject units 15A, 15B, four stackers 16A, 16B, 16C, 16D and a control unit 19. Further, this banknote handling machine 10 includes an operation unit (not shown) including various input keys respectively adapted for receiving an instruction given from an operator, and further includes a display unit (not shown) adapted for displaying conditions of the banknotes respectively stored in the stackers 16A, 16B, 16C, 16D.

The take-in unit 11 is configured such that the operator can place thereon each batch or batches of the paper sheets, and is adapted for taking the paper sheets, one by one, from the batch or batches of the paper sheets placed thereon, into a casing of the banknote handling machine 10. In this case, the take-in unit 11 takes the paper sheets, one by one, into the banknote handling machine 10, under the control of the control unit 19 that will be described later.

The transport unit 12 is provided in the casing of the banknote handling machine 10, and is adapted for transporting each paper sheet taken in the casing by the take-in unit 11, to each of the stackers 16A, 16B, 16C, 16D or reject units 15A, 15B. Usually, this transport unit 12 is composed of a combination of proper belt transport mechanisms. More specifically, each of such belt transport mechanisms is composed of a pair of or three or more rollers and a belt (or belts), such as a rubber belt (or rubber belts), provided over the respective rollers. In this case, the transport unit 12 can serve to transport the paper sheets, one by one, under the control of the control unit 19 as will be described later.

The transport-condition detection unit 13 is provided to the transport unit 12, and is composed of a sensor adapted for detecting transport conditions of each paper sheet taken in the casing by the take-in unit 11. Once it has detected some abnormality in transportation for each paper sheet, this transport-condition detection unit 13 will transmit a signal indicative of the abnormality in transportation (i.e., a transport-abnormality signal) to the control unit 19 that will be described later. More specifically, in the case some of the paper sheets are taken in the casing by the take-in unit 11 in an skewed state (i.e., in an skewed transport condition), or in the case some paper sheets are taken in the casing without any interval provided between the paper sheets (i.e., in a chain transport condition), or in the case some paper sheets are taken in the casing, while being overlapped one on another (i.e., in an overlap transport condition), the transport-condition detection unit 13 will transmit the transport-abnormality signal to the control unit 19.

The recognition unit 14 is provided to the transport unit 12 on the downstream side of the transport-condition detection unit 13, and is adapted for recognizing a certain recognition factor (e.g., the denomination, authenticity, fitness or the like) of each banknote, among the paper sheets respectively transported by the transport unit 12, as well as adapted for reading the serial number of the banknote. This recognition unit 14 is composed of, for example, a pair of line sensors, respectively located across (or on both sides of) the transport unit 12. Once recognizing the recognition factor of each banknote, the recognition unit 14 will transmit a recognition signal indicative of each recognition result on the banknote to the control unit 19 that will be described later. While the recognition unit 14 is shown as located on the downstream side relative to the transport-condition detection unit 13, this recognition unit 14 may be located on the upstream side of the transport-condition detection unit 13, or otherwise may be provided integrally with the transport-condition detection unit 13. Further, the recognition unit 14 may be adapted for reading the bar-code information on each bar-code ticket.

The reject units 15A, 15B are provided, respectively, for storing therein the paper sheets, each recognized, by the recognition unit 14, as an abnormal banknote or paper sheet different from a specified paper sheet. It is noted that the kind of each paper sheet to be fed to the reject units 15A, 15B will be discussed in detail, upon explanation of the method for handling the paper sheets that will be described later.

The stackers 16A, 16B, 16C, 16D are provided, respectively, for storing therein the paper sheets, each recognized, by the recognition unit 14, as a normal banknote, while such paper sheets are fed to each stacker by denomination. However, the function of each stacker 16A, 16B, 16C, 16D is not limited to this application. For instance, these stackers may be provided, respectively, for storing therein the banknotes, while such banknotes are sorted and fed to each stacker, not by denomination, but by any other suitable recognition factor, such as the face/back, orientation or the like, of each banknote. Further, the number of these stackers is not limited to four. For instance, eight stackers may be provided to the banknote handling machine 10. It is noted that the kind of each paper sheet to be fed to the stackers 16A, 16B, 16C, 16D will be discussed in detail, upon the explanation of the method for handling the paper sheets that will be described later.

The control unit 19 is connected to each of the take-in unit 11, transport unit 12, transport-condition detection unit 13, recognition unit 14, operation unit (not shown) and display unit (not shown). The control unit 19 is configured to receive the transport-abnormality signal indicative of the abnormality in transportation for each paper sheet and transmitted from the transport-condition detection unit 13 as well as receive the recognition signal indicative of the recognition result on each paper sheet and transmitted from the recognition unit 14, and then control the display unit to display thereon all or part of such information. Further, based on the recognition result on each paper sheet recognized by the recognition unit 14, the control unit 19 serves to control the take-in unit 11 and/or transport unit 12, as well as to control the delivery of each paper sheet to the respective stackers 16A, 16B, 16C, 16D. In addition, this control unit 19 can serve to transmit the recognition result on the denomination or the like of each banknote recognized by the recognition unit 14 to the cash settlement terminal 80 that will be described later.

Now, referring to FIG. 3, the bar-code ticket handling machine 20 will be described in detail. This bar-code ticket handling machine 20 can serve to take the paper sheets, one by one, from the exterior to the interior thereof, and then read the bar-code information on each bar-code ticket, among the paper sheets taken therein, while obtaining an image of the bar-code ticket.

As shown in FIG. 3, the bar-code ticket handling machine 20 includes a take-in unit 21, a transport unit 22, a transport-condition detection unit 23, a recognition unit 24, an image obtaining unit 27, a reject unit 25, two stackers 26A, 26B and a control unit 29. Further, this bar-code ticket handling machine 20 includes an operation unit (not shown) including various input keys respectively adapted for receiving an instruction given from the operator, and a display unit (not shown) adapted for displaying conditions of the bar-code tickets respectively stored in the stackers 26A, 26B.

The take-in unit 21 is configured such that the operator can place thereon each batch or batches of the paper sheets, and is adapted for taking the paper sheets into the casing of the bar-code ticket handling machine 20, one by one, from the batch or batches of the paper sheets placed thereon. In this case, the take-in unit 21 takes the paper sheets, one by one, into the bar-code ticket handling machine 20, under the control of the control unit 29 that will be described later.

The transport unit 22 is provided in the casing of the bar-code ticket handling machine 20, and is adapted for transporting each paper sheet taken in the casing by the take-in unit 21, to each of the stackers 26A, 26B or reject unit 25. Usually, this transport unit 22 is composed of a proper combination of the belt transport mechanisms. More specifically, each of such belt transport mechanisms is composed of the pair of or three or more rollers and the belt (or belts), such as the rubber belt (or rubber belts), provided over the respective rollers. In this case, the transport unit 22 can serve to transport the paper sheets, one by one, under the control of the control unit 29 as will be described later.

The transport-condition detection unit 23 is provided to the transport unit 22, and is composed of a proper sensor adapted for detecting the transport conditions of each paper sheet taken in the casing by the take-in unit 21. Once it has detected some abnormality in transportation for each paper sheet, the transport-condition detection unit 23 will transmit the transport-abnormality signal to the control unit 29 that will be described later. More specifically, in the case some of the paper sheets are taken in the casing by the take-in unit 21 in the skewed state (i.e., in the skewed transport condition), or in the case some paper sheets are taken in the casing without any interval provided between the paper sheets (i.e., in the chain transport condition), or in the case some paper sheets are taken in the casing, while being overlapped one on another (i.e., in the overlap transport condition), the transport-condition detection unit 23 will transmit the transport-abnormality signal to the control unit 29.

The recognition unit 24 is provided to the transport unit 22 on the downstream side of the transport-condition detection unit 23, and is adapted for recognizing whether or not each paper sheet transported by the transport unit 22 is the bar-code ticket. This recognition unit 24 is composed of, for example, the pair of line sensors, respectively located across (or on both sides of) the transport unit 22. Further, once it has recognized each paper sheet transported by the transport unit 22, as the bar-code ticket, the recognition unit 24 can read the bar-code information on the bar-code ticket. More specifically, this recognition unit 24 can read the bar-code information on each bar-code ticket, as an eighteen-digit number (or validation number). Then, the recognition signal on each paper sheet recognized by the recognition unit 24 (i.e., the signal indicative of whether or not this paper sheet is the bar-code ticket) and the bar-code information on this bar-code ticket read by the recognition unit 24 will be transmitted to the control unit 29. While this recognition unit 24 is shown as located on the downstream side relative to the transport-condition detection unit 23, the recognition unit 24 may be located on the upstream side of the transport-condition detection unit 23, or otherwise may be provided integrally with the transport-condition detection unit 23. Preferably, the line sensors constituting the recognition unit 24 are provided to read the bar-code information on both sides of each bar-code ticket. With this configuration, two kinds of bar-code information on each bar-code ticket, i.e., the bar-code information read from the front face of the bar-code ticket and the bar-code information read from the back face thereof, can be checked, and therefore the bar-code information can be read more accurately. Further, this recognition unit 24 may be adapted for reading the recognition factor (e.g., the denomination, authenticity, fitness or the like) of each banknote, as well as adapted for reading the serial number of the banknote.

The image obtaining unit 27 is provided to the transport unit 22 on the downstream side of the recognition unit 24. In this case, once each paper sheet that will be fed to the image obtaining unit 27 is recognized, as the bar-code ticket, by the recognition unit 24, the image obtaining unit 27 will obtain the image of the entire bar-code ticket. For instance, this image obtaining unit 27 is composed of an image scanner. The image of each bar-code ticket obtained by the image obtaining unit 27 will be sent to the control unit 29.

The reject unit 25 is configured to receive, for example, each barcode ticket that cannot be recognized by the recognition unit 24. It is noted that the kind of each paper sheet to be fed to this reject unit 25 will be discussed in detail, upon the explanation of the method for handling the paper sheets that will be described later.

For instance, in the case the recognition result on each paper sheet recognized by the recognition unit 24 is indicative of the bar-code ticket, each stacker 26A, 26B can serve to receive such bar-code tickets in a batch method. As used herein, the "batch method" means such a method that includes: first feeding the bar-code tickets to one stacker (e.g., the stacker 26A); and then feeding the bar-code tickets to the other stacker 26B, once the number of the bar-code tickets stored in the stacker 26A reaches a predetermined number (e.g., 100), and the operator takes out the 100 bar-code tickets stored in the stacker 26A, while the bar-code tickets are fed to and stored in the other stacker 26B. It is noted that the kind of each paper sheet fed to each stacker 26A, 26B will be discussed in detail, upon the explanation of the method for handling the paper sheets that will be described later.

The control unit 29 is connected to each of the take-in unit 21, transport unit 22, transport-condition detection unit 23, recognition unit 24, image obtaining unit 27, operation unit (not shown) and display unit (not shown). The control unit 29 is configured to receive the transport-abnormality signal on the abnormality in transportation for each paper sheet sent from the transport-condition detection unit 23, the recognition signal indicative of the recognition result on each paper sheet and the bar-code information on each bar-code ticket, respectively sent from the recognition unit 24, and the image of the bar-code ticket sent from the image obtaining unit 27. Then, the control unit 29 will control the display unit to display thereon, all or part of such information. Further, the control unit 29 is configured to control the take-in unit 21 and/or transport unit 22 as well as control the delivery of the bar-code tickets to the respective stackers 26A, 26B, based on the recognition result on each paper sheet recognized by the recognition unit 24. In addition, this control unit 29 can serve to transmit the bar-code information and image of each bar-code ticket, respectively obtained as described above, to the higher level terminal 82 that will be described later.

It is noted that each of the aforementioned banknote handling machine 10 and bar-code ticket handling machine 20 may be adapted for handling both the banknotes and bar-code tickets.

The handy bar-code scanner 30 is connected, for communication, to the cash settlement terminal 80, and is adapted for reading the bar-code information on each bar-code ticket, as the eighteen-digit number (or validation number).

The cash settlement terminal 80 is configured to receive the recognition result on the denomination or the like of each banknote recognized by the recognition unit 14, transmitted from the banknote handling machine 10, as well as receive the bar-code information on each bar-code ticket, transmitted from the handy bar-code scanner 30. While only one banknote handling machine 10 is shown, in FIG. 1, as connected, for communication, to one cash settlement terminal 80, a plurality of banknote handling machines 10 may be connected, respectively, for communication, to the single cash settlement terminal 80.

The cash settlement terminal 80 can serve to transmit the recognition result on the denomination or the like of each banknote, transmitted from the banknote handling machine 10, as well as transmit the bar-code information on each bar-code ticket read by the handy bar-code scanner 30, to the higher level terminal 82 that will be described below.

The higher level terminal 82 is configured to receive the bar-code information (more specifically, the eighteen-digit number (or validation number)) and/or obtained image of each bar-code ticket, respectively transmitted from the bar-code ticket handling machine 20. Further, the higher level terminal 82 is configured to receive the recognition result on the denomination or the like of each banknote that has been transmitted from the banknote handling machine 10 and the bar-code information on each bar-code ticket read by the handy bar-code scanner 30, respectively transmitted from the cash settlement terminal 80. While only one bar-code ticket handling machine 20 is shown, in FIG. 1, as connected, for communication, to one higher level terminal 82, a plurality of bar-code ticket handling machines 20 may be connected, respectively, for communication, to the single higher level terminal 82.

The casino host computer 84 is provided for controlling the entire system of a casino, and thus can serve as a further higher-ranking computer relative to the higher level terminal 82. This casino host computer 84 is configured to receive the bar-code information and/or image of each bar-code ticket, respectively obtained by the bar-code ticket handling machine 20, the recognition result on the denomination or the like of each banknote obtained by the banknote handling machine 10 and the bar-code information on each bar-code ticket read by the handy bar-code scanner 30, respectively transmitted from the higher level terminal 82.

Next, the operation of the paper sheet handling system constructed as described above will be discussed.

In the method for handling the paper sheets related to this embodiment, the paper sheet present at the uppermost or lowest part of each batch of the paper sheets is first assigned as the designated paper sheet, and then the intrinsic information on this designated paper sheet is associated with the transaction information corresponding to the batch of the paper sheets. As used herein, the "intrinsic information on the designated paper sheet" means the bar-code information (more specifically, the eighteen-digit number (or validation number)) of the bar-code ticket in the case the designated paper sheet is the bar-code ticket, while meaning the serial number of the banknote in the case the designated paper sheet is the banknote. Alternatively, in the case the designated paper sheet is the banknote, the denomination of this banknote may be used as the intrinsic information on the designated paper sheet, in addition to the serial number of this banknote. The operation for associating the intrinsic information on the designated paper sheet with the transaction information corresponding to each batch of the paper sheets is performed by the casino host computer 84. More specifically, the bar-code ticket present at the uppermost or lowest part of each batch of the paper sheets is read by the handy bar-code scanner 30, or otherwise the serial number of the banknote present at the uppermost or lowest part of each batch of the paper sheets is inputted, by hand, to the higher level terminal 82, via the keyboard 86. As a result, the intrinsic information on each designated paper sheet can be sent to the banknote handling machine 10, as well as can be sent to the bar-code ticket handling machine 20 and casino host computer 84, via the cash settlement terminal 80. Thus, the intrinsic information on each designated paper sheet can be associated with the transaction information corresponding to each batch of the paper sheets, by the casino host computer 84.

As the transaction information corresponding to each batch of the paper sheets, the ID information on each slot machine 92 or ID information on each cassette detachably attached to the slot machine 92 can be mentioned. In addition, the transaction information corresponding to each batch of the paper sheets includes a bank number, a branch-bank number, a bank-account number, a store number, a register number, a customer number and the like.

Figure 10:
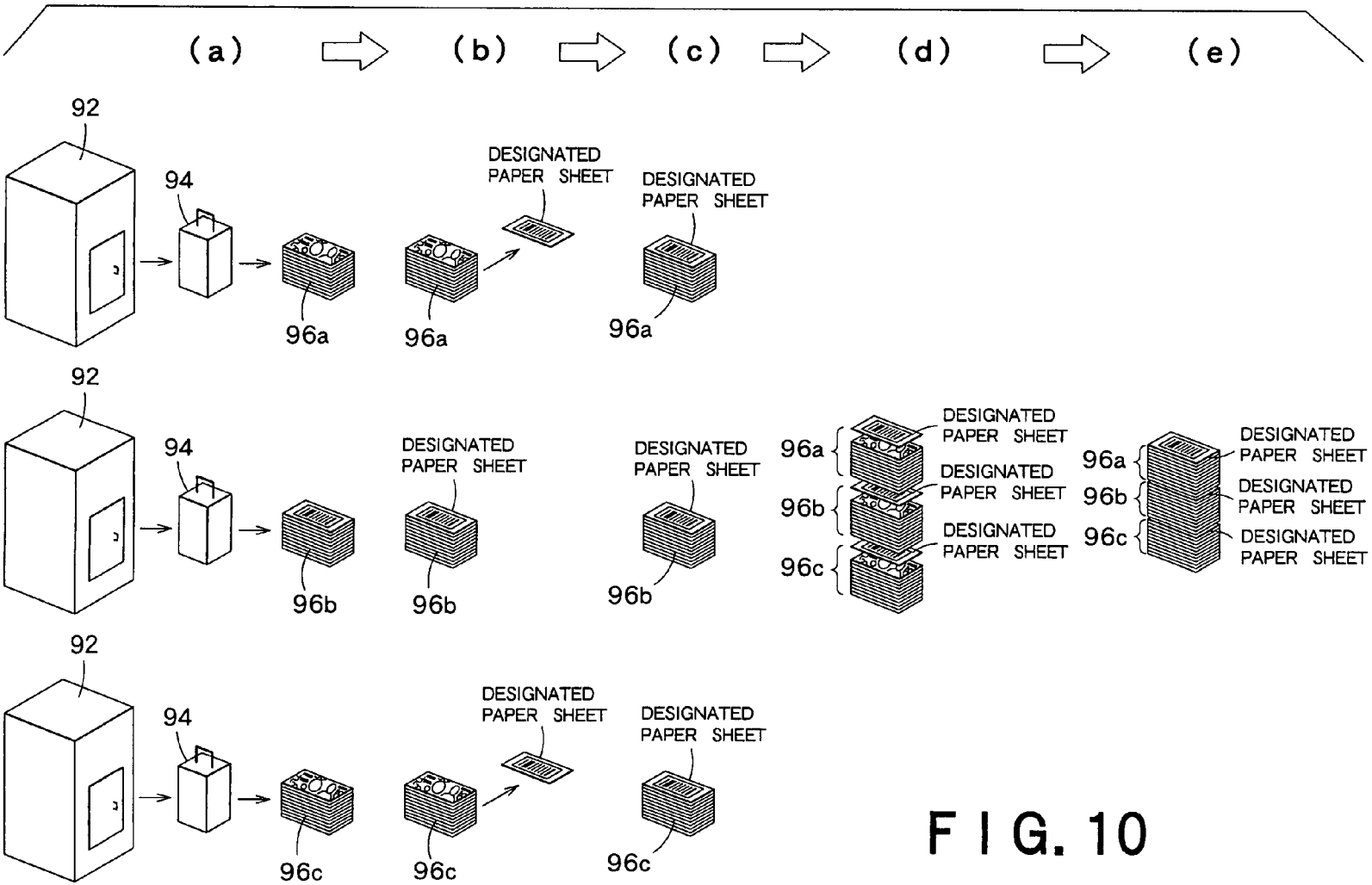
FIG. 10 is a diagram provided for illustrating operations for stacking the plurality of batches of the paper sheets, one on another, in the number corresponding to the transactions.

Now, referring to FIG. 10, the method for handling the paper sheets related to this embodiment will be described in more detail. First, as shown in FIG. 10(*a*), the cassette 94 is pulled out from each of the plurality of slot machines 92. In each cassette 94, the banknotes and bar-code tickets are stacked, respectively, in a mixed state. Then, each batch 96*a*, 96*b*, 96*c* of the paper sheets, respectively including the paper sheets and bar-code tickets in the mixed state, is taken out from each cassette 94. Thereafter, as shown in FIG. 10(*b*), the paper sheet present at the uppermost or lowest part of each batch of the paper sheets is assigned as the designated paper sheet. For instance, shown as the batch 96*b* of the paper sheets, when the paper sheet present at the uppermost part of this batch 96*b* is the bar-code ticket, this bar-code ticket is assigned as the designated paper sheet. Meanwhile, shown as each batch 96*a*, 96*c* of the paper sheets, when the paper sheet present at the uppermost part thereof is the banknote, an arbitrary one bar-code ticket included in each batch 96*a*, 96*c* of the paper sheets is pulled out from the batch 96*a* or 96*c*, and then moved to the uppermost part thereof, as shown in FIG. 10(*c*), to be used as the designated paper sheet.

Thereafter, the bar-code information (i.e., the eighteen-digit number (or validation number)) of the designated paper sheet of each batch 96*a*, 96*b*, 96*c* of the paper sheets, i.e., the bar-code ticket present at the uppermost part of each batch 96*a*, 96*b*, 96*c*, is read by the handy bar-code scanner 30, and then this bar-code information is associated with the ID information on each slot machine 92 or ID information on each cassette 94, corresponding to the batch 96*a*, 96*b* or 96*c* of the paper sheets. Thus, the relation between the paper sheets (i.e., the banknotes and/or bar-code tickets) included in each batch 96*a*, 96*b*, 96*c* and each slot machine 92 (or cassette 94), from which such paper sheets are taken out, can be checked.

Thereafter, the plurality of batches of the paper sheets will be stacked, one on another, in the number corresponding to the transactions, while the intrinsic information on the designated paper sheet of each batch of the paper sheet is already associated with the transaction information. For instance, as shown in FIGS. 10(*d*) and 10(*e*), the batches 96*a*, 96*b*, 96*c*, each having the designated paper sheet present at the uppermost part thereof, are stacked, one on another. Thereafter, such stacked batches of the paper sheets will be collectively handled by the banknote handling machine 10 and bar-code ticket handling machine 20.

Then, the host computer 84 separates each recognition result on the plurality of batches of the paper sheets, respectively handled by the banknote handling machine 10 and bar-code ticket handling machine 20, by each designated paper sheet. In this way, the information on the association between each recognition result on the paper sheets and the transaction information can be obtained.

Next, the operation of the paper sheet handling system constructed as described above will be discussed, more specifically, with reference to the flow charts respectively shown in FIGS. 4 through 9.

(First Aspect for Handling the Paper Sheets Including Only the Banknotes or Including Only the Bar-Code Tickets)

Now, referring to the flow chart of FIG. 4, a first aspect, in which the paper sheets to be handled by the paper sheet handling system include only the banknotes or include only the bar-code tickets, will be discussed.

In the case the paper sheets to be handled by the paper sheet handling system include only the banknotes, such paper sheets are handled by only the banknote handling machine 10 shown in FIG. 2, while the bar-code ticket handling machine 20 shown in FIG. 3 is not used for handling the paper sheets. Meanwhile, in the case the paper sheets to be handled by the paper sheet handling system include only the bar-code tickets, such paper sheets are handled by only the bar-code ticket handling machine 20 shown in FIG. 3, while the banknote handling machine 10 shown in FIG. 2 is not used for handling the paper sheets.

First of all, with reference to the flow chart of FIG. 4, the case, in which the paper sheets include only the bar-code tickets, when collectively handling the plurality of stacked batches of the paper sheets by the paper sheet handling system, and the designated paper sheet of each batch of the paper sheets is first handled in the handling operation for each batch of the paper sheets, will be discussed.

First, the paper sheet present at the uppermost part of each batch of the paper sheets, i.e., the bar-code ticket present at the uppermost part, is assigned as the designated paper sheet (or designated bar-code ticket). Then, the bar-code information on this designated bar-code ticket is read, as the eighteen-digit number (or validation number), by the handy bar-code scanner 30. Thereafter, the bar-code information read by the handy bar-code scanner 30 is sent to and stored in the bar-code ticket handling machine 20 as well as sent to the casino host computer 84, as the intrinsic information on the designated bar-code ticket. Thus, in this casino host computer 84, the intrinsic information on the designated bar-code ticket can be associated with the transaction information corresponding to each batch of the paper sheets.

Then, the plurality of batches of the paper sheets are stacked, one on another, in the number corresponding to the transactions, while each designated bar-code ticket is already associated with the corresponding transaction information. Subsequently, the paper sheets included in each of such stacked batches are taken, in succession, one by one, into the bar-code ticket handling machine 20 (see STEP 1 in FIG. 4). In this case, the designated bar-code ticket present at the uppermost part of each stacked batch of the paper sheets is first taken into the bar-code ticket handling machine 20. Thereafter, in this bar-code ticket handling machine 20, the bar-code information (i.e., the eighteen-digit number (or validation number)) of each bar-code ticket that is taken, one by one, into the machine 20 is read by the recognition unit 24 (see STEP 2 in FIG. 4), and then the image of this bar-code ticket is obtained by the image obtaining unit 27 (see STEP 3 in FIG. 4). Then, whether or not the bar-code information read by the recognition unit 24 corresponds to the information on the designated bar-code ticket that has been received from the higher level terminal 82 is checked (see STEP 4 in FIG. 4). It is noted that each bar-code ticket having the bar-code information that cannot be read by the recognition unit 24 (i.e., each rejected bar-code ticket) will be fed to the reject unit 25.

Figure 4:
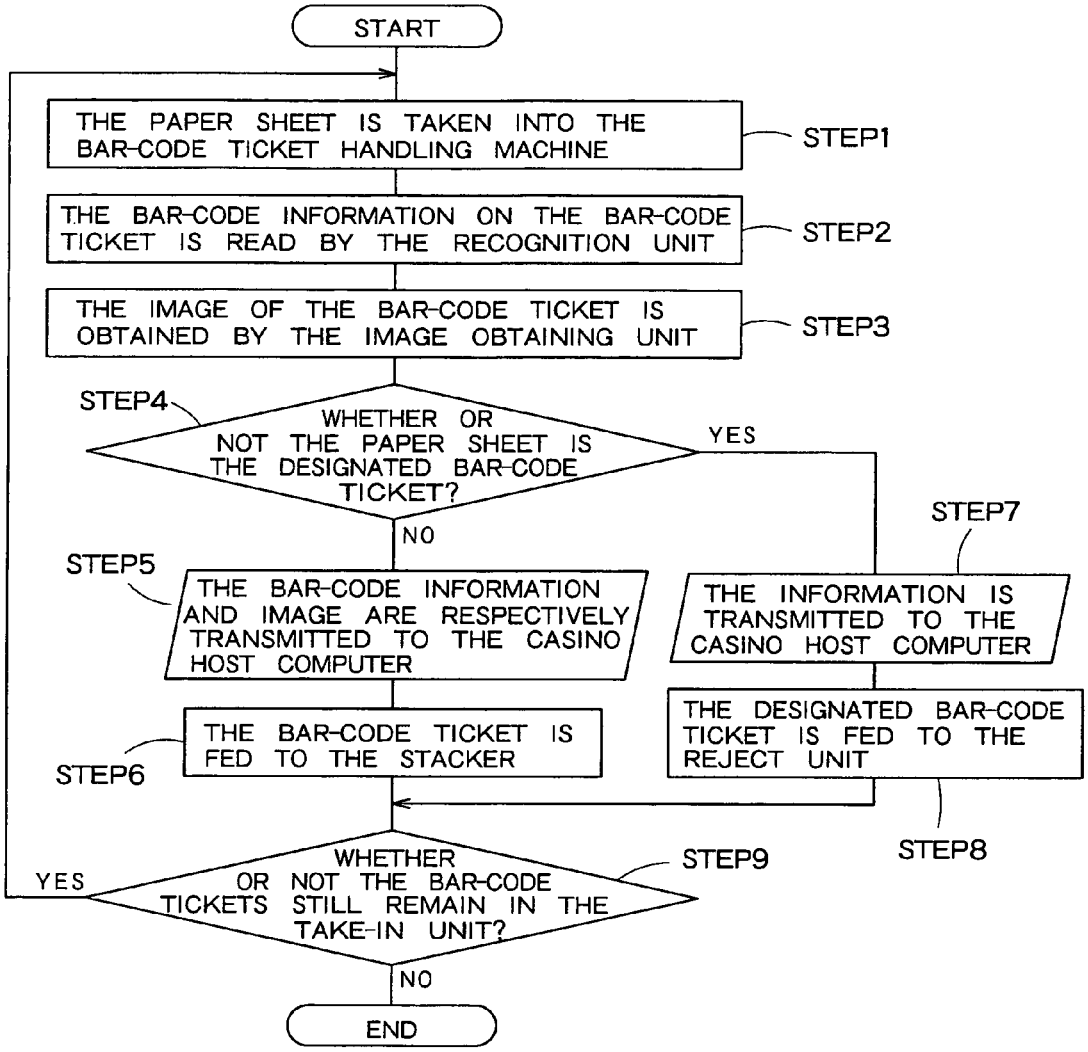
FIG. 4 is a flow chart illustrating one method for handling the paper sheets by using the paper sheet handling system shown in FIG. 1.

If the bar-code ticket taken in the bar-code ticket handling machine 20 is not determined as the designated bar-code ticket, the bar-code information (i.e., the eighteen-digit number (or validation number)) of this bar-code ticket read by the recognition unit 24 as well as the image of the bar-code ticket obtained by the image obtaining unit 27 will be respectively transmitted to the casino host computer 84, via the higher level terminal 82 (see STEP 5 in FIG. 4). Then, this bar-code ticket will be stored, in the batch method, in either one of the two stackers 26A, 26B (see STEP 6 in FIG. 4).

Meanwhile, in the case the bar-code ticket taken in the bar-code ticket handling machine 20 is determined as the designated bar-code ticket, the information on this determination is transmitted to the casino host computer 84, via the higher level terminal 82 (see STEP 7 in FIG. 4), and then each recognition result on the plurality of batches of the paper sheets, respectively handled by the bar-code ticket handling machine 20, is separated, by such a designated bar-code ticket. More specifically, when a certain bar-code ticket is handled by the bar-code ticket handling machine 20, the transaction information, with which the intrinsic information on the designated bar-code ticket that has been handled by the bar-code ticket handling machine 20 before the certain bar-code ticket is associated, will be judged to be associated with the certain bar-code ticket, by the casino host computer 84. In this way, the information on the association between each recognition result on the paper sheets and the transaction information can be obtained. Then, the designated bar-code ticket will be fed to the reject unit 25 (see STEP 8 in FIG. 4).

Thereafter, whether or not the bar-code tickets still remain in the take-in unit 21 is checked (see STEP 9 in FIG. 4). If some bar-code tickets still remain in the take-in unit 21, the operations, as respectively described in the STEPs 1 through 8 respectively shown in FIG. 4, will be repeated. Meanwhile, if the bar-code tickets no longer remain in the take-in unit 21, the handling operation for the plurality of batches of the paper sheets, by the bar-code ticket handling machine 20, will be once ended. Thereafter, the rejected bar-code tickets and designated bar-code tickets, respectively fed to and stacked in the reject unit 25, are placed again on the take-in unit 21, collectively, in the number corresponding to the transactions, while the order of stacking such bar-code tickets is kept (i.e., with the rejected bar-code tickets respectively remaining stacked, one on another, between the designated bar-code tickets). Then, the operation mode is changed into a reject handling mode where such stacked bar-code tickets are handled again by the bar-code ticket handling machine 20. In this reject handling mode, even if the bar-code ticket is judged as the designated bar-code ticket, the bar-code information and image of such a designated bar-code ticket are respectively transmitted to the casino host computer 84, via the higher level terminal 82, and then such a designated bar-code ticket will be fed to either one of the stackers 26A, 26B, as in the case of handling each normal bar-code ticket. In addition, the bar-code information and image of each bar-code ticket that can be read as the normal one, among the bar-code tickets other than the designated bar-code tickets, are transmitted to the casino host computer 84, via the higher level terminal 82. Meanwhile, the bar-code ticket, whose bar-code information cannot be read, is fed to the reject unit 25, and then a next feeding operation for the bar-code tickets will be stopped. Thereafter, such bar-code ticket stored in the reject unit 25 is confirmed by the operator, and the bar-code data of this bar-code ticket will be inputted, by hand, in order to register it as error bar-code tickets. In such a reject handling mode, there is a need for stopping the operation of the system, once some bar-code ticket is judged as rejected one. Therefore, it is preferred to employ such a method that can take the paper sheets (or bar-code tickets) into the casing, intermittently, while checking them one by one.

Also, in the case the paper sheets include only the banknotes, when collectively handling the plurality of stacked batches of the paper sheets by using the paper sheet handling system, if the designated paper sheet of each batch of the paper sheets is first handled in the handling operation for the batch of the paper sheets, the handling operation for such paper sheets is carried out in substantially the same manner as illustrated by the flow chart shown in FIG. 4.

Namely, the paper sheet present at the uppermost part of each batch of the paper sheets, i.e., the banknote present at the uppermost part, is first assigned as the designated paper sheet (or designated banknote). Then, the serial number of this designated banknote is inputted, by hand, to the higher level terminal 82, via the keyboard 86. Thereafter, the serial number of the designated banknote inputted, by hand, to the higher level terminal 82 is sent to and stored in the banknote handling machine 10 as well as sent to the casino host computer 84, as the intrinsic information on the banknote. Thus, in this casino host computer 84, the intrinsic information on the designated banknote can be associated with the transaction information corresponding to each batch of the paper sheets.

Then, the plurality of batches of the paper sheets are stacked, one on another, in the number corresponding to the transactions, while each designated banknote is already associated with the transaction information. Subsequently, the paper sheets included in each of such stacked batches are taken, in succession, one by one, into the banknote handling machine 10. In this case, the designated banknote present at the uppermost part of each stacked batch of the paper sheets is taken, first, into the banknote handling machine 10. Thereafter, in this banknote handling machine 10, the recognition factor (e.g., the denomination, authenticity, fitness or the like) of each banknote that has been taken, one by one, into the machine 10 is recognized by the recognition unit 14, as well as the serial number of the banknote is read by the recognition unit 14. Then, whether or not the serial number of each banknote read by the recognition unit 14 is identified with the serial number of the designated banknote that has been received from the higher level terminal 82 is checked. It is noted that each banknote that cannot be recognized by the recognition unit 14 (i.e., each rejected banknote) will be fed to either one of the reject units 15A, 15B.

If the banknote taken in the banknote handling machine 10 is not determined as the designated banknote, the recognition information on this banknote recognized by the recognition unit 14 will be transmitted to the casino host computer 84, via the higher level terminal 82. Then, this banknote will be stored in any suitable one of the four stackers 16A, 16B, 16C, 16D.

Meanwhile, in the case the banknote taken in the banknote handling machine 10 is determined as the designated banknote, the information on this determination is transmitted to the casino host computer 84, via the higher level terminal 82, and then each recognition result on the plurality of batches of the paper sheets, respectively handled by the banknote handling machine 10, is separated, by such a designated banknote. More specifically, when a certain banknote is handled by the banknote handling machine 10, the transaction information, with which the intrinsic information on the designated banknote that has been handled by the banknote handling machine 10 before the certain banknote is associated, will be judged to be associated with the certain banknote, by the casino host computer 84. In this way, the information on the association between each recognition result on the paper sheets and the transaction information can be obtained. Then, the designated banknote will be fed to either one of the reject units 15A, 15B.

Thereafter, whether or not the banknotes still remain in the take-in unit 11 is checked. If some banknotes still remain in the take-in unit 11, the operations, as respectively described above, will be repeated. Meanwhile, if the banknotes no longer remain in the take-in unit 11, the handling operation for the plurality of batches of the paper sheets, by the banknote handling machine 10, will be once ended. Thereafter, the rejected banknotes and designated banknotes, respectively fed to and stacked in the reject units 15A, 15B, are placed again on the take-in unit 11, collectively, in the number corresponding to the transactions, while the order of stacking such banknotes is kept (i.e., with the rejected banknotes respectively remaining stacked, one on another, between the designated banknotes). Then, the operation mode is changed into the reject handling mode where such stacked banknotes are handled again by the banknote handling machine 10. In this reject handling mode, even if the banknote is judged as the designated banknote, the recognition information on such a designated banknote is transmitted to the casino host computer 84, via the higher level terminal 82, and then such a designated banknote will be fed to any suitable one of the stackers 16A, 16B, 16C, 16D, as in the case of handling each normal banknote. In addition, the recognition information on each banknote that can be recognized, among the banknotes other than the designated banknotes, is transmitted to the casino host computer 84, via the higher level terminal 82. Meanwhile, the banknote that cannot be recognized is fed to the reject units 15A, 15B, and then a next feeding operation for the banknotes will be stopped. Thereafter, such banknote stored in the reject units 15A, 15B is confirmed by the operator, and the denomination or the like of this banknote will be inputted, by hand, in order to register it as error banknote. In such a reject handling mode, there is the need for stopping the operation of the system, once some banknote is judged as rejected one. Therefore, it is preferred to employ such a method that can take the banknotes into the system, intermittently, while checking them one by one.

(Second Aspect for Handling the Paper Sheets Including Only the Banknotes or Including Only the Bar-Code Tickets)

Now, referring to the flow chart of FIG. 5, a second aspect, in which the paper sheets to be handled by the paper sheet handling system include only the banknotes or include only the bar-code tickets, will be discussed.

First of all, the case, in which the paper sheets include only the bar-code tickets, when collectively handling the plurality of stacked batches of the paper sheets by the paper sheet handling system, and the designated paper sheet of each batch of the paper sheets is last handled in the handling operation for each batch of the paper sheets, will be discussed, with reference to the flow chart of FIG. 5.

First, the paper sheet present at the lowest part of each batch of the paper sheets, i.e., the bar-code ticket present at the lowest part, is assigned as the designated paper sheet (or designated bar-code ticket). Then, the bar-code information on this designated bar-code ticket is read, as the eighteen-digit number (or validation number), by the handy bar-code scanner 30. Thereafter, the bar-code information read by the handy bar-code scanner 30 is sent to and stored in the bar-code ticket handling machine 20 as well as sent to the casino host computer 84, as the intrinsic information on the designated bar-code ticket. Thus, in this casino host computer 84, the intrinsic information on the designated bar-code ticket can be associated with the transaction information corresponding to each batch of the paper sheets.

Then, the plurality of batches of the paper sheets are stacked, one on another, in the number corresponding to the transactions, while each designated bar-code ticket is already associated with the transaction information. Subsequently, the paper sheets included in each of such stacked batches are taken, in succession, one by one, into the bar-code ticket handling machine 20 (see STEP 1 in FIG. 5). In this case, the designated bar-code ticket present at the lowest part of each stacked batch of the paper sheets is taken, last, into the bar-code ticket handling machine 20. Thereafter, in this bar-code ticket handling machine 20, the bar-code information (i.e., the eighteen-digit number (or validation number)) of each bar-code ticket that has been taken, one by one, into the machine 20 is read by the recognition unit 24 (see STEP 2 in FIG. 5), and then the image of this bar-code ticket is obtained by the image obtaining unit 27 (see STEP 3 in FIG. 5). Then, whether or not the bar-code information read by the recognition unit 24 corresponds to the information on the designated bar-code ticket that has been received from the higher level terminal 82 is checked (see STEP 4 in FIG. 5). It is noted that each bar-code ticket having the bar-code information that cannot be read by the recognition unit 24 (i.e., each rejected bar-code ticket) will be fed to the reject unit 25.

Figure 5:
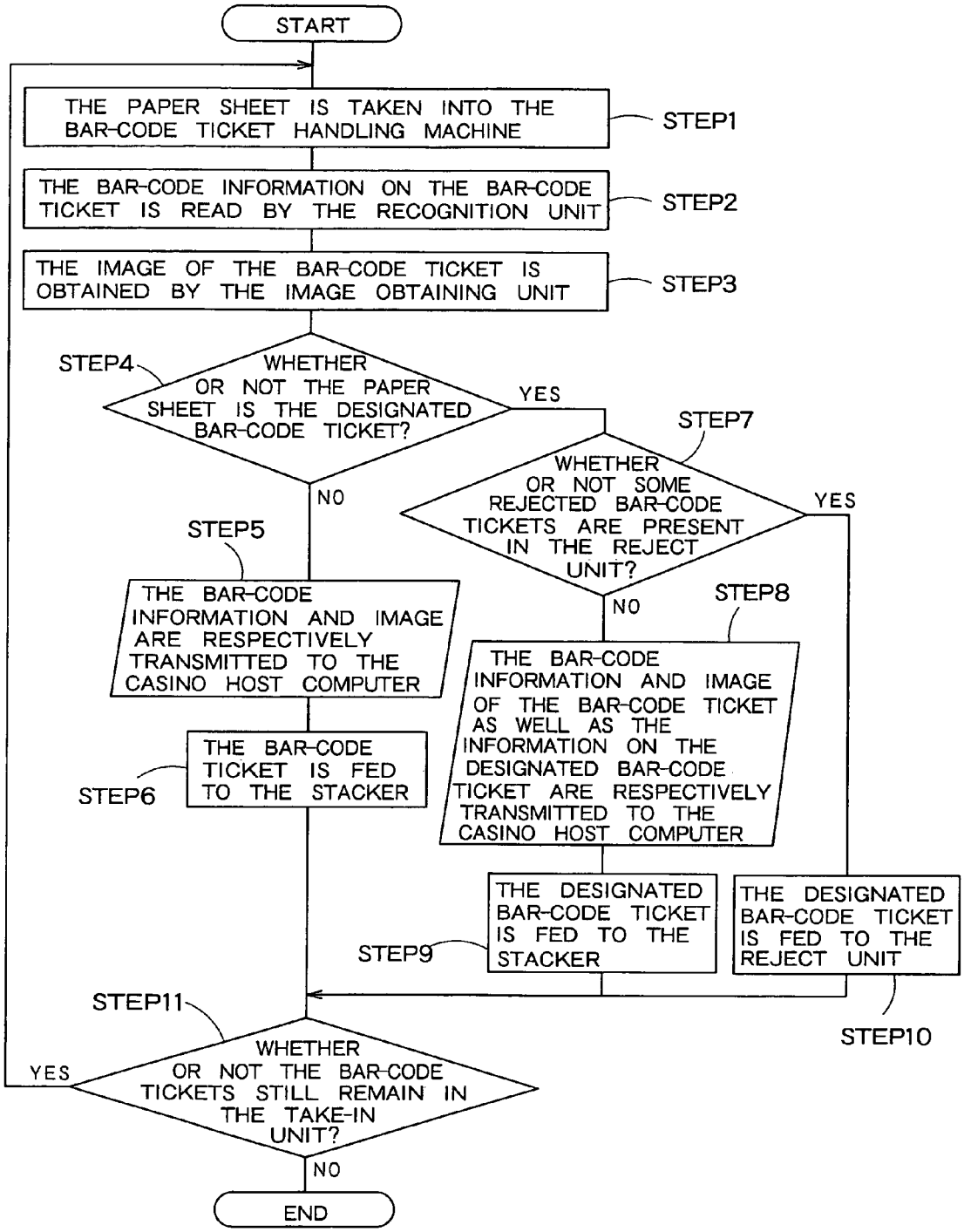
FIG. 5 is a flow chart illustrating another method for handling the paper sheets by using the paper sheet handling system shown in FIG. 1.

If the bar-code ticket taken in the bar-code ticket handling machine 20 is not determined as the designated bar-code ticket, the bar-code information (i.e., the eighteen-digit number (or validation number)) of this bar-code ticket read by the recognition unit 24 as well as the image of the bar-code ticket obtained by the image obtaining unit 27 will be respectively transmitted to the casino host computer 84, via the higher level terminal 82 (see STEP 5 in FIG. 5). Then, this bar-code ticket will be stored, in the batch method, in either one of the two stackers 26A, 26B (see STEP 6 in FIG. 5).

Meanwhile, in the case the bar-code ticket taken in the bar-code ticket handling machine 20 is determined as the designated bar-code ticket, whether or not some rejected bar-code tickets (respectively related to the transaction associated with this designated bar-code ticket) are present in the reject unit 25 after the previous designated bar-code ticket, will be further checked (see STEP 7 in FIG. 5). As a result, if such rejected bar-code tickets are judged not to be present in the reject unit 25, the bar-code information (i.e., the eighteen-digit number (or validation number)) of the designated bar-code ticket read by the recognition unit 24 and the image of this designated bar-code ticket obtained by the image obtaining unit 27 will be respectively transmitted to the casino host computer 84, via the higher level terminal 82, as well as the information on the fact that the designated bar-code ticket is taken in the bar-code ticket handling machine 20 will be transmitted to the casino host computer 84, via the higher level terminal 82 (see STEP 8 in FIG. 5). Then, each recognition result on the plurality of batches of the paper sheets, respectively handled by the bar-code ticket handling machine 20, is separated, by such a designated bar-code ticket. More specifically, when a certain bar-code ticket is handled by the bar-code ticket handling machine 20, the transaction information, with which the intrinsic information on the designated bar-code ticket that is handled by the bar-code ticket handling machine 20 after the certain bar-code ticket is associated, will be judged to be associated with the certain bar-code ticket, by the casino host computer 84. In this way, the information on the association between each recognition result on the paper sheets and the transaction information can be obtained. Then, the designated bar-code ticket will be fed to either one of the two stackers 26A, 26B (see STEP 9 in FIG. 5).

Meanwhile, if some rejected bar-code tickets (respectively related to the transaction associated with the designated bar-code ticket) are judged to be present in the reject unit 25 after the previous designated bar-code ticket, such a designated bar-code ticket taken in the bar-code ticket handling machine 20 will also be fed to the reject unit 25 (see STEP 10 in FIG. 5).

Thereafter, whether or not the bar-code tickets still remain in the take-in unit 21 is checked (see STEP 11 in FIG. 5). If some bar-code tickets still remain in the take-in unit 21, the operations, as respectively described in the STEPs 1 through 10 respectively shown in FIG. 5, will be repeated. Meanwhile, if the bar-code tickets no longer remain in the take-in unit 21, the handling operation for the plurality of batches of the paper sheets, by the bar-code ticket handling machine 20, will be once ended. Thereafter, the rejected bar-code tickets and designated bar-code tickets, respectively fed to and stacked in the reject unit 25, are placed again on the take-in unit 21, collectively, in the number corresponding to the transactions, while the order of stacking such bar-code tickets is kept (i.e., with the rejected bar-code tickets and designated bar-code tickets respectively corresponding to the transactions related to the rejected bar-code tickets, remaining stacked, respectively, in succession, one on another). Then, the operation mode is changed into the reject handling mode where such stacked bar-code tickets are handled again by the bar-code ticket handling machine 20. In this reject handling mode, the bar-code information and image of each bar-code ticket that can be read as the normal one, among the bar-code tickets other than the designated bar-code tickets, as well as the bar-code information and image of each designated bar-code ticket are respectively transmitted to the casino host computer 84, via the higher level terminal 82. Meanwhile, the bar-code ticket, whose bar-code information cannot be read, is fed to the reject unit 25, and then a next feeding operation for the bar-code tickets will be stopped, once the bar-code information on the designated bar-code ticket, which is to be handled after such bar-code ticket, is read. Thereafter, such bar-code ticket stored in the reject unit 25 is confirmed by the operator, and the bar-code data of this bar-code ticket will be inputted, by hand, in order to register it as the error bar-code ticket. In such a reject handling mode, there is the need for stopping the operation of the system, once some bar-code ticket is judged as rejected one. Therefore, it is preferred to employ such a method that can take the bar-code tickets into the system, intermittently, while checking them one by one.

Also, in the case the paper sheets include only the banknotes, when collectively handling the plurality of stacked batches of the paper sheets by the paper sheet handling system, and when the designated paper sheet of each batch of the paper sheets is last handled in the handling operation for each batch of the paper sheets, the handling operation for such paper sheets is carried out in substantially the same manner as illustrated by the flow chart shown in FIG. 5.

Namely, the paper sheet present at the lowest part of each batch of the paper sheets, i.e., the banknote present at the lowest part, is first assigned as the designated paper sheet (or designated banknote). Then, the serial number of this designated banknote is inputted, by hand, to the higher level terminal 82, via the keyboard 86. Thereafter, the serial number of the designated banknote inputted, by hand, to the higher level terminal 82 is sent to and stored in the banknote handling machine 10 as well as sent to the casino host computer 84, as the intrinsic information on the designated banknote. Thus, in this casino host computer 84, the intrinsic information on the designated banknote can be associated with the transaction information corresponding to each batch of the paper sheets.

Then, the plurality of batches of the paper sheets are stacked, one on another, in the number corresponding to the transactions, while each designated banknote is already associated with the transaction information. Subsequently, the paper sheets included in each of such stacked batches are taken, in succession, one by one, into the banknote handling machine 10. In this case, the designated banknote present at the lowest part of each stacked batch of the paper sheets is taken, last, into the banknote handling machine 10. Thereafter, in this banknote handling machine 10, the recognition factor (e.g., the denomination, authenticity, fitness or the like) of each banknote that has been taken, one by one, into the machine 10 is recognized by the recognition unit 14, as well as the serial number of the banknote is read by the recognition unit 14. Then, whether or not the serial number of each banknote read by the recognition unit 14 is identified with the serial number of the designated banknote that has been received from the higher level terminal 82 is checked. It is noted that each banknote that cannot be recognized by the recognition unit 14 (i.e., each rejected banknote) will be fed to either one of the reject units 15A, 15B.

If the banknote taken in the banknote handling machine 10 is not determined as the designated banknote, the recognition information on this banknote recognized by the recognition unit 14 will be transmitted to the casino host computer 84, via the higher level terminal 82. Then, this banknote will be stored in any suitable one of the four stackers 16A, 16B, 16C, 16D.

Meanwhile, in the case the banknote taken in the banknote handling machine 10 is determined as the designated banknote, whether or not some rejected banknotes (respectively related to the transaction associated with this designated banknote) are present in the reject unit 15A or 15B after the previous designated banknote, will be further checked. As a result, if such rejected banknotes are judged not to be present in the reject unit 15A or 15B, the recognition result on the designated banknote recognized by the recognition unit 14 will be transmitted to the casino host computer 84, via the higher level terminal 82, as well as the information on the fact that the designated banknote is taken in the banknote handling machine 10 will be transmitted to the casino host computer 84, via the higher level terminal 82. Then, each recognition result on the plurality of batches of the paper sheets, respectively handled by the banknote handling machine 10, is separated, by utilizing such a designated banknote. More specifically, when a certain banknote is handled by the banknote handling machine 10, the transaction information, with which the intrinsic information on the designated banknote that is handled by the banknote handling machine 10 after the certain banknote is associated, will be judged to be associated with the certain banknote, by the casino host computer 84. In this way, the information on the association between each recognition result on the paper sheets and the transaction information can be obtained. Then, the designated banknote will be fed to any suitable one of the four stackers 16A, 16B, 16C, 16D.

Meanwhile, if some rejected banknotes (respectively related to the transaction associated with the designated banknote) are judged to be present in the reject unit 15A or 15B after the previous designated banknote, such a designated banknote taken in the banknote handling machine 10 will also be fed to the reject unit 15A or 15B.

Thereafter, whether or not the banknotes still remain in the take-in unit 11 is checked. If some banknotes still remain in the take-in unit 11, the operations, as respectively described above, will be repeated. Meanwhile, if the banknotes no longer remain in the take-in unit 11, the handling operation for the plurality of batches of the paper sheets, by the banknote handling machine 10, will be once ended. Thereafter, the rejected banknotes and designated banknotes, respectively fed to and stacked in the reject units 15A, 15B, are placed again on the take-in unit 11, collectively, in the number corresponding to the transactions, while the order of stacking such banknotes is kept (i.e., with the rejected banknotes and designated banknotes respectively corresponding to the transactions related to the rejected banknotes, remaining stacked, respectively, in succession, one on another). Then, the operation mode is changed into the reject handling mode where such stacked banknotes are handled again by the banknote handling machine 10. In this reject handling mode, the recognition information on each banknote that can be recognized, among the banknotes other than the designated banknotes, is transmitted to the casino host computer 84, via the higher level terminal 82. Meanwhile, the banknote that cannot be recognized is fed to either one of the reject units 15A, 15B, and then a next feeding operation for the banknotes will be stopped, once the designated banknote, which is to be handled after such banknote, is recognized. Thereafter, such banknote stored in either one of the reject units 15A, 15B is confirmed by the operator, and the denomination or the like of this banknote will be inputted, by hand, in order to register it as the error banknote. In such a reject handling mode, there is the need for stopping the operation of the system, once some banknote is judged as rejected one. Therefore, it is preferred to employ such a method that can take the banknotes into the system, intermittently, while checking them one by one.

(First Aspect for Handling the Paper Sheets Including Both the Banknotes and Bar-Code Tickets, in the Mixed State)

Now, referring to the flow chart of FIG. 6, a first aspect, in which the paper sheets to be handled by the paper sheet handling system include both the banknotes and bar-code tickets, in the mixed state, will be discussed.

Figure 6:
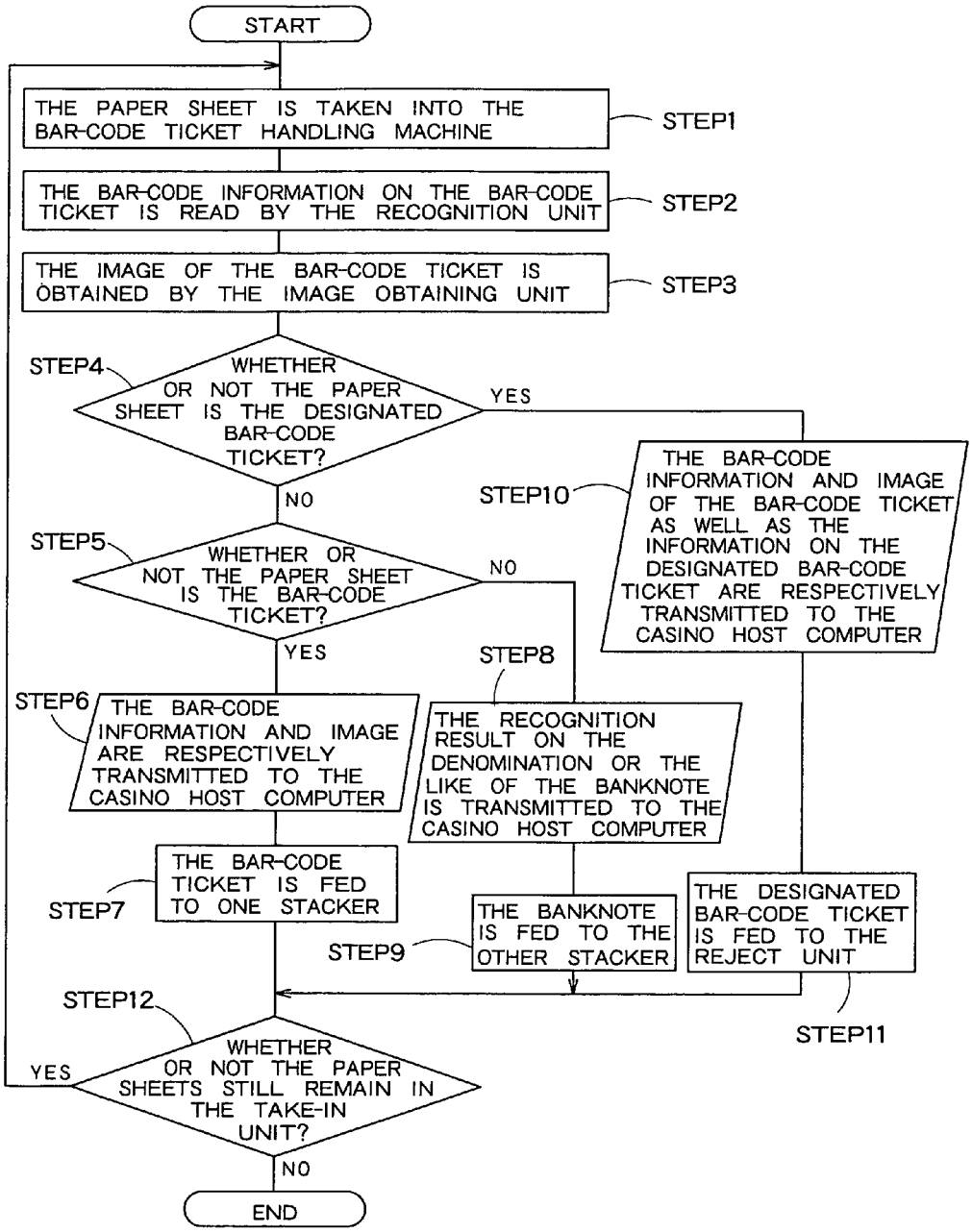
FIG. 6 is a flow chart illustrating still another method for handling the paper sheets by using the paper sheet handling system shown in FIG. 1.

In the method for handling the paper sheets, as illustrated by the flow chart of FIG. 6, only the bar-code ticket handling machine 20 shown in FIG. 3 is used for handling the paper sheets, while the banknote handling machine 10 shown in FIG. 2 is not used.

Further, in the method for handling the paper sheets, as illustrated by the flow chart of FIG. 6, the designated paper sheet of each batch of the paper sheets is first handled in the handling operation for the batch of the paper sheets, when collectively handling the plurality of stacked batches of the paper sheets by the paper sheet handling system.

First, the paper sheet (i.e., the bar-code ticket) present at the uppermost part of each batch of the paper sheets is assigned as the designated paper sheet (or designated bar-code ticket). In this case, if the paper sheet present at the uppermost part of a certain batch of the paper sheets is the banknote, an arbitrary bar-code ticket included in this batch of the paper sheets will be moved to the uppermost part of the batch of the paper sheets, and used as the designated bar-code ticket. Then, the bar-code information on each designated bar-code ticket is read, as the eighteen-digit number (or validation number), by the handy bar-code scanner 30. Thereafter, the bar-code information read by the handy bar-code scanner 30 is sent to and stored in the bar-code ticket handling machine 20 as well as sent to the casino host computer 84, as the intrinsic information on the designated bar-code ticket. Thus, in this casino host computer 84, the intrinsic information on the designated bar-code ticket can be associated with the transaction information corresponding to each batch of the paper sheets.

Then, the plurality of batches of the paper sheets are stacked, one on another, in the number corresponding to the transactions, while each designated bar-code ticket is already associated with the transaction information. Subsequently, the paper sheets included in each of such stacked batches are taken, in succession, one by one, into the bar-code ticket handling machine 20 (see STEP 1 in FIG. 6). In this case, the designated bar-code ticket present at the uppermost part of each stacked batch of the paper sheets is first taken into the bar-code ticket handling machine 20. Thereafter, if the paper sheet taken in the bar-code ticket handling machine 20 is the bar-code ticket, the bar-code information (i.e., the eighteen-digit number (or validation number)) of this bar-code ticket is read by the recognition unit 24 (see STEP 2 in FIG. 6), and then the image of this bar-code ticket is obtained by the image obtaining unit 27 (see STEP 3 in FIG. 6). The bar-code ticket, whose bar-code information cannot be read by the recognition unit 24 (i.e., the rejected bar-code ticket), will be fed to the reject unit 25. Meanwhile, if the paper sheet taken in the bar-code ticket handling machine 20 is the banknote, the recognition factor (e.g., the denomination, authenticity, fitness or the like) of this banknote is recognized by the recognition unit 24. In this case, the banknote that cannot be recognized by the recognition unit 24 (i.e., each rejected banknote) will be fed to the reject unit 25.

Thereafter, whether or not the paper sheet taken in the bar-code ticket handling machine 20 is the designated bar-code ticket is checked (see STEP 4 in FIG. 6).

If the paper sheet taken in the bar-code ticket handling machine 20 is not determined as the designated bar-code ticket, whether or not this paper sheet is the bar-code ticket is further checked (see STEP 5 in FIG. 6).

As a result, if the paper sheet taken in the bar-code ticket handling machine 20 is the bar-code ticket, the bar-code information (i.e., the eighteen-digit number (or validation number)) of this bar-code ticket read by the recognition unit 24 as well as the image of this bar-code ticket obtained by the image obtaining unit 27 are respectively transmitted to the casino host computer 84, via the higher level terminal 82 (see STEP 6 in FIG. 6). Then, this bar-code ticket will be stored in one (e.g., the stacker 26A) of the two stackers 26A, 26B (see STEP 7 in FIG. 6).

Meanwhile, if the paper sheet taken in the bar-code ticket handling machine 20 is the banknote, the recognition result on the denomination or the like of the banknote obtained by the recognition unit 24 is transmitted to the casino host computer 84, via the higher level terminal 82 (see STEP 8 in FIG. 6). Then, this banknote will be stored in the other (e.g., the stacker 26B) of the two stackers 26A, 26B (see STEP 9 in FIG. 6).

In the case the bar-code ticket taken in the bar-code ticket handling machine 20 is determined as the designated bar-code ticket, the bar-code information on this designated bar-code ticket read by the recognition unit 24 will be transmitted to the casino host computer 84, via the higher level terminal 82, as well as the information on the fact that the designated bar-code ticket is taken in the bar-code ticket handling machine 20 will be transmitted to the casino host computer 84, via the higher level terminal 82 (see STEP 10 in FIG. 6). Then, each recognition result on the plurality of batches of the paper sheets, respectively handled by the bar-code ticket handling machine 20, is separated, by such a designated bar-code ticket. More specifically, when a certain paper sheet is handled by the bar-code ticket handling machine 20, the transaction information, with which the intrinsic information on the designated bar-code ticket that has been handled by the bar-code ticket handling machine 20 before the certain paper sheet is associated, will be judged to be associated with the certain paper sheet, by the casino host computer 84. In this way, the information on the association between each recognition result on the paper sheets and the transaction information can be obtained. Then, the designated bar-code ticket will be fed to the reject unit 25 (see STEP 11 in FIG. 6).

Thereafter, whether or not the paper sheets still remain in the take-in unit 21 is checked (see STEP 12 in FIG. 6). If some paper sheets still remain in the take-in unit 21, the operations, as respectively described in the STEPs 1 through 11 respectively shown in FIG. 6, will be repeated. Meanwhile, if the paper sheets no longer remain in the take-in unit 21, the handling operation for the plurality of batches of the paper sheets, by the bar-code ticket handling machine 20, will be once ended. Thereafter, the rejected bar-code tickets, rejected banknotes and designated bar-code tickets, respectively fed to and stacked in the reject unit 25, are placed again on the take-in unit 21, collectively, in the number corresponding to the transactions, while the order of stacking such paper sheets is kept (i.e., with the rejected bar-code tickets and/or rejected banknotes, remaining stacked, respectively, one on another, between the designated bar-code tickets). Then, the operation mode is changed into the reject handling mode where such stacked paper sheets are handled again by the bar-code ticket handling machine 20. In this reject handling mode, the bar-code information and image of such a designated bar-code ticket are respectively transmitted, as in the case of each normal bar-code ticket, to the casino host computer 84, via the higher level terminal 82, and then fed to either one of the stackers 26A, 26B. In addition, the bar-code information and image of each bar-code ticket that can be read as the normal one, among the bar-code tickets other than the designated bar-code tickets, are respectively transmitted to the casino host computer 84, via the higher level terminal 82. Furthermore, the recognition information on each banknote that can be recognized, among the rejected banknotes, is also transmitted to the casino host computer 84, via the higher level terminal 82. Meanwhile, the bar-code ticket, whose bar-code information cannot be read, as well as the banknote that cannot be recognized is fed to the reject unit 25, and then a next feeding operation for the paper sheets will be stopped. Thereafter, such bar-code ticket or banknote stored in the reject unit 25 is confirmed by the operator, and the bar-code data and the like of these paper sheet will be inputted, by hand, in order to register it as the error bar-code ticket or error banknote. In such a reject handling mode, there is the need for stopping the operation of the system, once some paper sheet is judged as rejected one. Therefore, it is preferred to employ such a method that can take the bar-code tickets and/or banknotes into the system, intermittently, while checking them one by one.

(Second Aspect for Handling the Paper Sheets Including Both the Banknotes and Bar-Code Tickets, in the Mixed State)

Now, referring to the flow chart of FIG. 7, a second aspect, in which the paper sheets to be handled by the paper sheet handling system include both the banknotes and bar-code tickets, in the mixed state, will be discussed.

Figure 7:
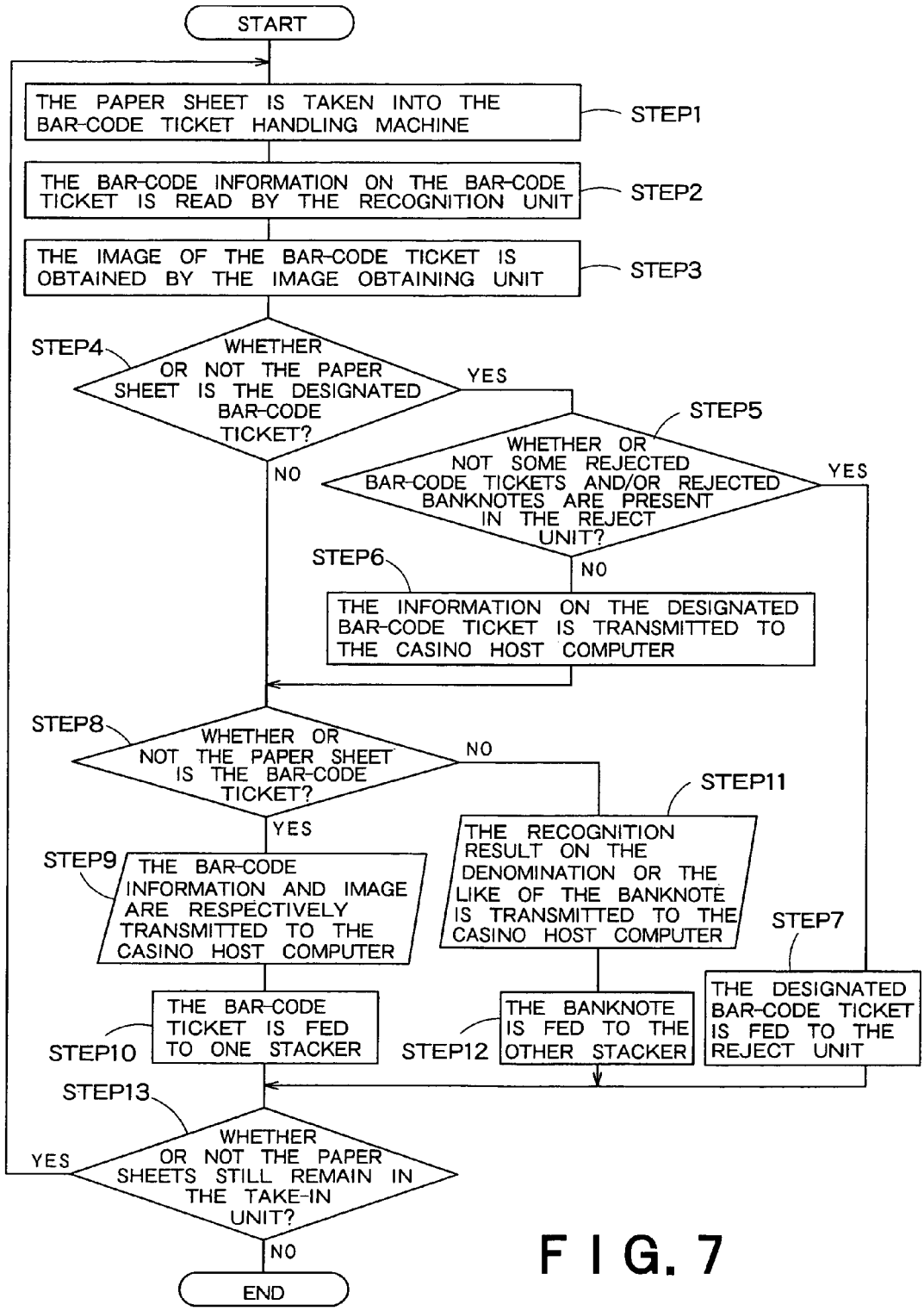
FIG. 7 is a flow chart illustrating yet still another method for handling the paper sheets by using the paper sheet handling system shown in FIG. 1.

In the method for handling the paper sheets, as illustrated by the flow chart of FIG. 7, only the bar-code ticket handling machine 20 shown in FIG. 3 is used for handling the paper sheets, while the banknote handling machine 10 shown in FIG. 2 is not used.

Further, in the method for handling the paper sheets, as illustrated by the flow chart of FIG. 7, the designated paper sheet of each batch of the paper sheets is last handled in the handling operation for each batch of the paper sheets, when collectively handling the plurality of stacked batches of the paper sheets by using the paper sheet handling system.

First, the paper sheet (i.e., the bar-code ticket) present at the lowest part of each batch of the paper sheets is assigned as the designated paper sheet (or designated bar-code ticket). In this case, if the paper sheet present at the lowest part of a certain batch of the paper sheets is the banknote, an arbitrary bar-code ticket included in this batch of the paper sheets will be moved to the lowest part of the batch of the paper sheets, and used as the designated bar-code ticket. Then, the bar-code information on each designated bar-code ticket is read, as the eighteen-digit number (or validation number), by the handy bar-code scanner 30. Thereafter, the bar-code information read by the handy bar-code scanner 30 is sent to and stored in the bar-code ticket handling machine 20 as well as sent to the casino host computer 84, as the intrinsic information on the designated bar-code ticket. Thus, in this casino host computer 84, the intrinsic information on the designated bar-code ticket can be associated with the transaction information corresponding to each batch of the paper sheets.

Then, the plurality of batches of the paper sheets are stacked, one on another, in the number corresponding to the transactions, while each designated bar-code ticket is already associated with the transaction information. Subsequently, the paper sheets included in each of such stacked batches are taken, in succession, one by one, into the bar-code ticket handling machine 20 (see STEP 1 in FIG. 7). In this case, the designated bar-code ticket present at the lowest part of each stacked batch of the paper sheets is taken, last, into the barcode ticket handling machine 20. Thereafter, if the paper sheet taken in the bar-code ticket handling machine 20 is the bar-code ticket, the bar-code information (i.e., the eighteen-digit number (or validation number)) of this bar-code ticket is read by the recognition unit 24 (see STEP 2 in FIG. 7), and then the image of this bar-code ticket is obtained by the image obtaining unit 27 (see STEP 3 in FIG. 7). The bar-code ticket, whose bar-code information cannot be read by the recognition unit 24 (i.e., the rejected bar-code ticket), will be fed to the reject unit 25. Meanwhile, if the paper sheet taken in the bar-code ticket handling machine 20 is the banknote, the recognition factor (e.g., the denomination, authenticity, fitness or the like) of the banknote is recognized by the recognition unit 24. In this case, the banknote that cannot be recognized by the recognition unit 24 (i.e., each rejected banknote) will be fed to the reject unit 25.

Thereafter, whether or not the paper sheet taken in the bar-code ticket handling machine 20 is the designated bar-code ticket is checked (see STEP 4 in FIG. 7).

In the case the bar-code ticket taken in the bar-code ticket handling machine 20 is determined as the designated bar-code ticket, whether or not some rejected bar-code tickets and/or rejected banknotes (respectively related to the transaction associated with this designated bar-code ticket) are present in the reject unit 25 after the previous designated bar-code ticket, will be further checked (see STEP 5 in FIG. 7). If such rejected bar-code tickets and rejected banknotes are judged not to be present in the reject unit 25, the information on the fact that the designated bar-code ticket is taken in the bar-code ticket handling machine 20 will be transmitted to the casino host computer 84, via the higher level terminal 82 (see STEP 6 in FIG. 7). Then, each recognition result on the plurality of batches of the paper sheets, respectively handled by the bar-code ticket handling machine 20, is separated, by such a designated bar-code ticket. More specifically, when a certain paper sheet is handled by the bar-code ticket handling machine 20, the transaction information, with which the intrinsic information on the designated bar-code ticket that is handled by the bar-code ticket handling machine 20 after the certain paper sheet is associated, will be judged to be associated with the certain paper sheet, by the casino host computer 84. In this way, the information on the association between each recognition result on the paper sheets and the transaction information can be obtained. Meanwhile, if some rejected bar-code tickets and/or rejected banknotes (respectively related to the transaction associated with the designated bar-code ticket) are judged to be present in the reject unit 25 after the previous designated bar-code ticket, such a designated bar-code ticket taken in the bar-code ticket handling machine 20 will be fed to the reject unit 25 (see STEP 7 in FIG. 7).

Further, in the case the paper sheet taken in the bar-code ticket handling machine 20 is not determined as the designated bar-code ticket, or in the case although the paper sheet taken in the bar-code ticket handling machine 20 is determined as the designated bar-code ticket, there is no rejected bar-code tickets and/or no rejected banknotes present in the reject unit 25, whether or not this paper sheet is the bar-code ticket is checked (see STEP 8 in FIG. 7).

If the paper sheet taken in the bar-code ticket handling machine 20 is the bar-code ticket, the bar-code information (i.e., the eighteen-digit number (or validation number)) of this bar-code ticket read by the recognition unit 24 as well as the image of the bar-code ticket obtained by the image obtaining unit 27 will be respectively transmitted to the casino host computer 84, via the higher level terminal 82 (see STEP 9 in FIG. 7). Then, this bar-code ticket will be stored in one (e.g., the stacker 26A) of the two stackers 26A, 26B (see STEP 10 in FIG. 7).

Meanwhile, if the paper sheet taken in the bar-code ticket handling machine 20 is the banknote, the recognition result on the denomination or the like of the banknote obtained by the recognition unit 24 will be transmitted to the casino host computer 84, via the higher level terminal 82 (see STEP 11 in FIG. 7). Then, this banknote will be stored in the other (e.g., the stacker 26B) of the two stackers 26A, 26B (see STEP 12 in FIG. 7).

Thereafter, whether or not the banknotes still remain in the take-in unit 21 is checked (see STEP 13 in FIG. 7). If some banknotes still remain in the take-in unit 21, the operations, as respectively described in the STEPs 1 through 12 respectively shown in FIG. 7, will be repeated. Meanwhile, if the banknotes no longer remain in the take-in unit 21, the handling operation for the plurality of batches of the paper sheets, by the bar-code ticket handling machine 20, will be once ended. Thereafter, the rejected bar-code tickets, rejected banknotes and designated bar-code tickets, respectively fed to and stacked in the reject unit 25, are placed again on the take-in unit 21, collectively, in the number corresponding to the transactions, while the order of stacking such paper sheets is kept (i.e., with the rejected bar-code tickets, rejected banknotes and designated bar-code tickets respectively corresponding to the transactions related to those rejected bar-code tickets and/or the rejected banknotes, remaining stacked, respectively, in succession, one on another). Then, the operation mode is changed into the reject handling mode where such stacked paper sheets are handled again by the bar-code ticket handling machine 20. In this reject handling mode, the bar-code information and image of each bar-code ticket that can be read as the normal one, among the bar-code tickets other than the designated bar-code tickets, as well as the bar-code information and image of each designated bar-code ticket are respectively transmitted to the casino host computer 84, via the higher level terminal 82. Further, in this reject handling mode, the recognition information on each banknote that can be recognized, among the rejected banknotes, is also transmitted to the casino host computer 84, via the higher level terminal 82. Meanwhile, the bar-code ticket, whose bar-code information cannot be read, as well as the banknote that cannot be recognized is fed to the reject unit 25, and then a next feeding operation for the paper sheets will be stopped, once the bar-code information on the designated bar-code ticket, which is to be handled after such bar-code ticket or banknote, is read. Thereafter, such bar-code ticket or banknote stored in the reject unit 25 is confirmed by the operator, and the bar-code data and the like of this paper sheet will be inputted, by hand, in order to register it as the error bar-code ticket or error banknote. In such a reject handling mode, there is the need for stopping the operation of the system, once some paper sheet is judged as rejected one. Therefore, it is preferred to employ such a method that can take the bar-code tickets and/or banknotes into the system, intermittently, while checking them one by one.

(Third Aspect for Handling the Paper Sheets Including Both the Banknotes and Bar-Code Tickets, in the Mixed State)

Now, referring to the flow charts of FIGS. 8A and 8B, a third aspect, in which the paper sheets to be handled by the paper sheet handling system include both the banknotes and bar-code tickets, in the mixed state, will be discussed.

Figure 8A:
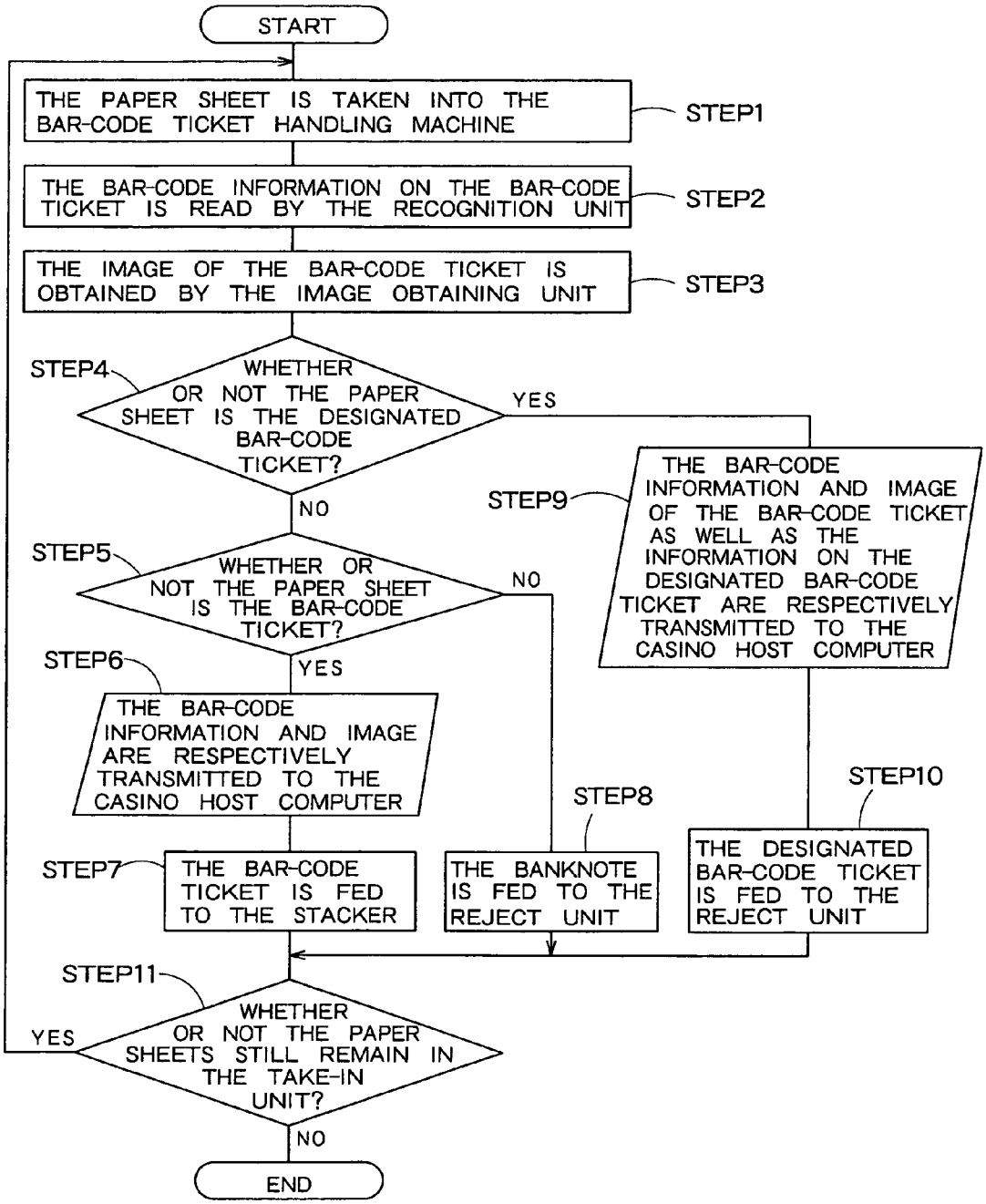
FIGS. 8A and 8B are flow charts illustrating yet still another method for handling the paper sheets by using the paper sheet handling system shown in FIG. 1.
Figure 8B:
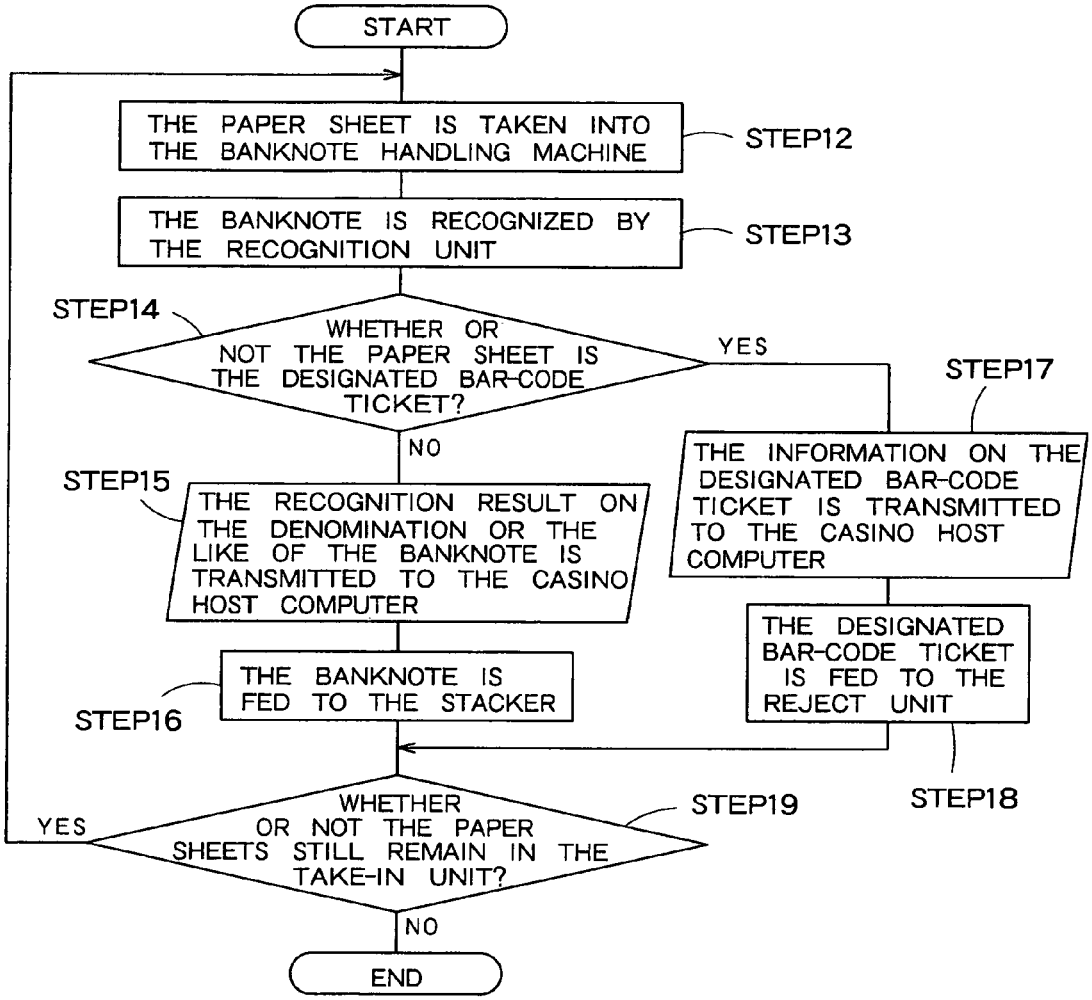

In the method for handling the paper sheets, as illustrated by the flow charts of FIGS. 8A and 8B, the bar-code ticket handling machine 20 shown in FIG. 3 is first used for handling the paper sheets, and then the paper sheets respectively fed to the reject unit 25 of the bar-code ticket handling machine 20 are handled by the banknote handling machine 10 shown in FIG. 2.

In the method for handling the paper sheets, as illustrated by the flow chart of FIGS. 8A and 8B, the designated paper sheet of each batch of the paper sheets is first handled in the handling operation for the batch of the paper sheets, when collectively handling the plurality of stacked batches of the paper sheets by using the paper sheet handling system.

First, the paper sheet (i.e., the bar-code ticket) present at the uppermost part of each batch of the paper sheets is assigned as the designated paper sheet (or designated bar-code ticket). In this case, if the paper sheet present at the uppermost part of a certain batch of the paper sheets is the banknote, an arbitrary bar-code ticket included in this batch of the paper sheets will be moved to the uppermost part of the batch of the paper sheets, and used as the designated bar-code ticket. Then, the bar-code information on each designated bar-code ticket is read, as the eighteen-digit number (or validation number), by the handy bar-code scanner 30. Thereafter, the bar-code information read by the handy bar-code scanner 30 is sent to and stored in both the paper sheet handling machine 10 and bar-code ticket handling machine 20 as well as sent to the casino host computer 84, as the intrinsic information on the designated bar-code ticket. Thus, in this casino host computer 84, the intrinsic information on the designated bar-code ticket can be associated with the transaction information corresponding to each batch of the paper sheets.

Then, the plurality of batches of the paper sheets are stacked, one on another, in the number corresponding to the transactions, while each designated bar-code ticket is already associated with the transaction information. Subsequently, the paper sheets included in each of such stacked batches are taken, in succession, one by one, into the bar-code ticket handling machine 20 (see STEP 1 in FIG. 8A). In this case, the designated bar-code ticket present at the uppermost part of each stacked batch of the paper sheets is first taken into the bar-code ticket handling machine 20. Thereafter, if the paper sheet taken in the bar-code ticket handling machine 20 is the bar-code ticket, the bar-code information (i.e., the eighteen-digit number (or validation number)) of this bar-code ticket is read by the recognition unit 24 (see STEP 2 in FIG. 8A), and then the image of this bar-code ticket is obtained by the image obtaining unit 27 (see STEP 3 in FIG. 8A). The bar-code ticket, whose bar-code information cannot be read by the recognition unit 24 (i.e., the rejected bar-code ticket), will be fed to the reject unit 25.

Thereafter, whether or not the paper sheet taken in the bar-code ticket handling machine 20 is the designated bar-code ticket is checked (see STEP 4 in FIG. 8A).

If the paper sheet taken in the bar-code ticket handling machine 20 is not determined as the designated bar-code ticket, whether or not this paper sheet is the bar-code ticket is further checked (see STEP 5 in FIG. 8A).

If the paper sheet taken in the bar-code ticket handling machine 20 is the bar-code ticket, the bar-code information (i.e., the eighteen-digit number (or validation number)) of this bar-code ticket read by the recognition unit 24 as well as the image of this bar-code ticket obtained by the image obtaining unit 27 are respectively transmitted to the casino host computer 84, via the higher level terminal 82 (see STEP 6 in FIG. 8A). Then, this bar-code ticket will be stored in either one of the two stackers 26A, 26B (see STEP 7 in FIG. 8A).

Meanwhile, if the paper sheet taken in the bar-code ticket handling machine 20 is the banknote, this banknote is fed to the reject unit 25 (see STEP 8 in FIG. 8A).

In the case the bar-code ticket taken in the bar-code ticket handling machine 20 is determined as the designated bar-code ticket, the bar-code information on this designated bar-code ticket read by the recognition unit 24 will be transmitted to the casino host computer 84, via the higher level terminal 82, as well as the information on the fact that the designated bar-code ticket is taken in the bar-code ticket handling machine 20 will be transmitted to the casino host computer 84, via the higher level terminal 82 (see STEP 9 in FIG. 8A). Then, each recognition result on the plurality of batches of the paper sheets, respectively handled by the bar-code ticket handling machine 20, is separated, by such a designated bar-code ticket. More specifically, when a certain bar-code ticket is handled by the bar-code ticket handling machine 20, the transaction information, with which the intrinsic information on the designated bar-code ticket that has been handled by the bar-code ticket handling machine 20 before the certain bar-code ticket is associated, will be judged to be associated with the certain bar-code ticket, by the casino host computer 84. In this way, the information on the association between each recognition result on the bar-code tickets and the transaction information can be obtained. Then, the designated bar-code ticket will be fed to the reject unit 25 (see STEP 10 in FIG. 8A).

Thereafter, whether or not the paper sheets still remain in the take-in unit 21 is checked (see STEP 11 in FIG. 8A). If some paper sheets still remain in the take-in unit 21, the operations, as respectively described in the STEPs 1 through 10 respectively shown in FIG. 8A, will be repeated. Meanwhile, if the paper sheets no longer remain in the take-in unit 21, the handling operation for the plurality of batches of the paper sheets, by the bar-code ticket handling machine 20, will be once ended.

Thereafter, the rejected bar-code tickets, designated bar-code tickets and banknotes, respectively fed to and stacked in the reject unit 25, are taken out from the reject unit 25, while the order of stacking such paper sheets is kept. Then, such stacked paper sheets of the rejected bar-code tickets, designated bar-code tickets and banknotes, taken out from the reject unit 25, will be respectively handled by the banknote handling machine 10.

The stacked paper sheets of the rejected bar-code tickets, designated bar-code tickets and banknotes, taken out from the reject unit 25 of the bar-code ticket handling machine 20, are placed on the take-in unit 11 of the banknote handling machine 10, and then taken, in succession, one by one, into the banknote handling machine 10 (see STEP 12 in FIG. 8B). If the paper sheet taken in the banknote handling machine 10 is the banknote, this banknote will be recognized by the recognition unit 14 (see STEP 13 in FIG. 8B). The banknote that cannot be recognized by the recognition unit 14 (i.e., the rejected banknote) will be fed to either one of the reject units 15A, 15B. Further, this recognition unit 14 can serve to read the bar-code information (i.e., the eighteen-digit number (or validation number)) of the designated bar-code ticket. In this case, the bar-code ticket, whose bar-code information cannot be read by the recognition unit 14 (i.e., the rejected bar-code ticket), will be fed to either one of the reject units 15A, 15B.

Then, the higher level terminal 82 judges whether or not the paper sheet taken in the banknote handling machine 10 is the designated bar-code ticket (see STEP 14 in FIG. 8B).

If the paper sheet taken in the banknote handling machine 10 is not determined as the designated bar-code ticket, this paper sheet will be assigned as the banknote, and then the recognition result on the denomination or the like of this banknote obtained by the recognition unit 14 will be transmitted to the casino host computer 84, via the higher level terminal 82 (see STEP 15 in FIG. 8B). Thereafter, this banknote will be stored in any suitable one of the four stackers 16A, 16B, 16C, 16D (see STEP 16 in FIG. 8B).

Meanwhile, if the paper sheet taken in the banknote handling machine 10 is determined as the designated bar-code ticket, the information on the fact that the designated bar-code ticket is taken in the banknote handling machine 10 will be transmitted to the casino host computer 84, via the higher level terminal 82 (see STEP 17 in FIG. 8B). Then, each recognition result on the stacked paper sheets, respectively handled by the banknote handling machine 10, is separated, by utilizing such a designated banknote. More specifically, when a certain banknote is handled by the banknote handling machine 10, the transaction information, with which the intrinsic information on the designated bar-code ticket that has been handled by the banknote handling machine 10 before the certain banknote is associated, will be judged to be associated with the certain banknote, by the casino host computer 84. In this way, the information on the association between each recognition result on the banknotes and the transaction information can be obtained. Then, the designated bar-code ticket will be fed to either one of the reject units 15A, 15B (see STEP 18 in FIG. 8B).

Thereafter, whether or not the paper sheets still remain in the take-in unit 21 is checked (see STEP 19 in FIG. 8B). If some paper sheets still remain in the take-in unit 21, the operations, as respectively described in the STEPs 12 through 18 respectively shown in FIG. 8B, will be repeated. Meanwhile, if the paper sheets no longer remain in the take-in unit 21, the handling operation for the plurality of batches of the paper sheets, by using the banknote handling machine 10, will be ended.

(Fourth Aspect for Handling the Paper Sheets Including Both the Banknotes and Bar-Code Tickets, in the Mixed State)

Now, referring to the flow charts of FIGS. 9A and 9B, a fourth aspect, in which the paper sheets to be handled by the paper sheet handling system include both the banknotes and bar-code tickets, in the mixed state, will be discussed.

Figure 9A:
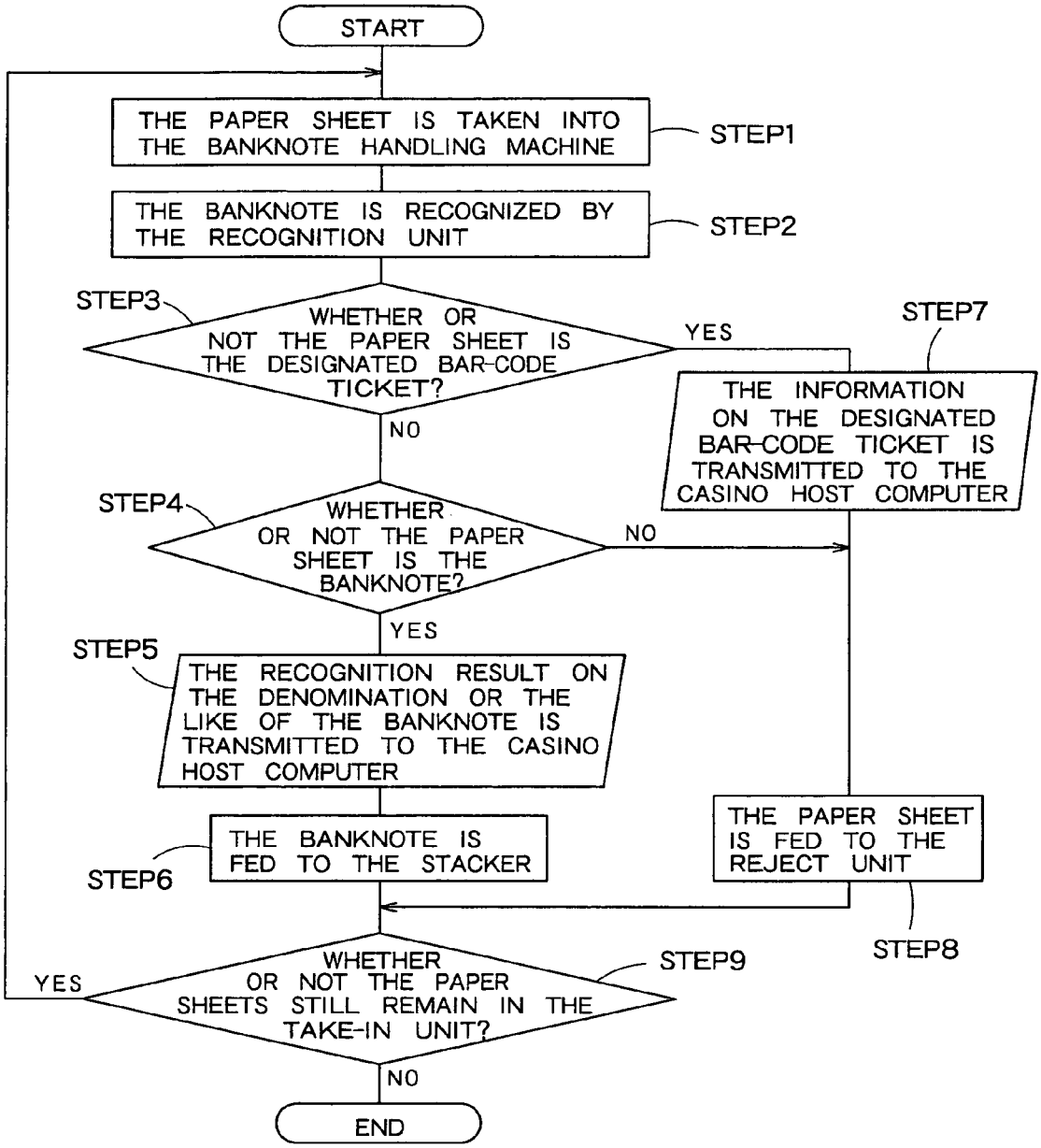
FIGS. 9A and 9B are flow charts illustrating yet still another method for handling the paper sheets by using the paper sheet handling system shown in FIG. 1.
Figure 9B:
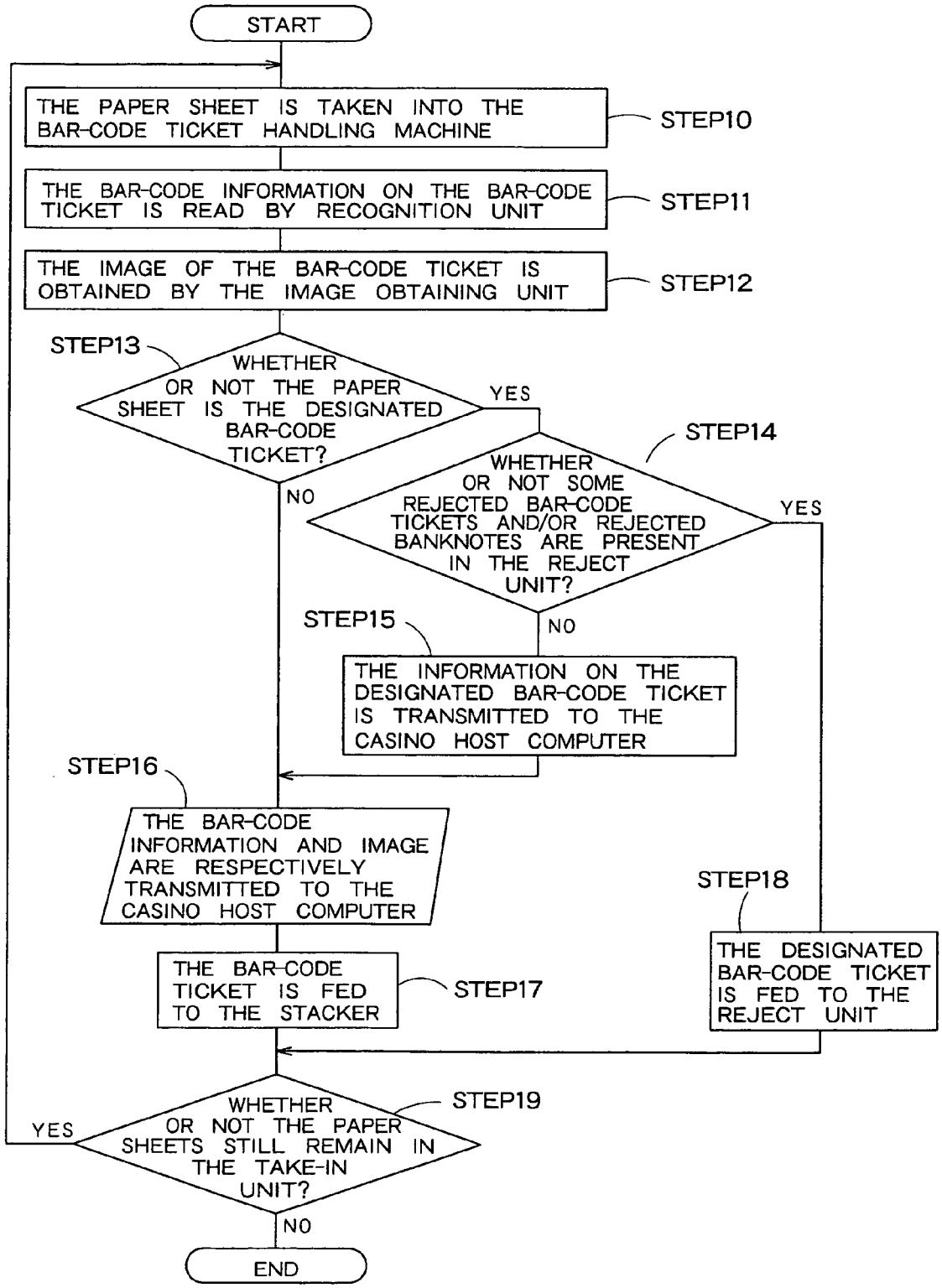

In the method for handling the paper sheets, as illustrated by the flow charts of FIGS. 9A and 9B, the banknote handling machine 10 shown in FIG. 2 is first used for handling the paper sheets, and then the paper sheets respectively fed to the reject units 15A, 15B of the banknote handling machine 10 are handled by the bar-code ticket handling machine 20 shown in FIG. 3.

In the method for handling the paper sheets, as illustrated by the flow charts of FIGS. 9A and 9B, the designated paper sheet of each batch of the paper sheets is last handled in the handling operation for each batch of the paper sheets, when collectively handling the plurality of stacked batches of the paper sheets by using the paper sheet handling system.

First, the paper sheet (i.e., the bar-code ticket) present at the lowest part of each batch of the paper sheets is assigned as the designated paper sheet (or designated bar-code ticket). If the paper sheet present at the lowest part of a certain batch of the paper sheets is the banknote, an arbitrary bar-code ticket included in this batch of the paper sheets will be moved to the lowest part of the batch of the paper sheets, and used as the designated bar-code ticket. Then, the bar-code information on each designated bar-code ticket is read, as the eighteen-digit number (or validation number), by the handy bar-code scanner 30. Thereafter, the bar-code information read by the handy bar-code scanner 30 is sent to and stored in both the paper sheet handling machine 10 and bar-code ticket handling machine 20 as well as sent to the casino host computer 84, as the intrinsic information on the designated bar-code ticket. Thus, in this casino host computer 84, the intrinsic information on the designated bar-code ticket can be associated with the transaction information corresponding to each batch of the paper sheets.

Then, the plurality of batches of the paper sheets are stacked, one on another, in the number corresponding to the transactions, while each designated bar-code ticket is already associated with the transaction information. Subsequently, the paper sheets included in each of such stacked batches are taken, in succession, one by one, into the banknote handling machine 10 (see STEP 1 in FIG. 9A). In this case, the designated bar-code ticket present at the lowest part of each stacked batch of the paper sheets is last taken into the banknote handling machine 10. If the paper sheet taken in the banknote handling machine 10 is the banknotes, such a banknote will be recognized by the recognition unit 14 (see STEP 2 in FIG. 9A). The banknote that cannot be recognized by the recognition unit 14 (i.e., each rejected banknote) will be fed to either one of the reject units 15A, 15B. Further, the recognition unit 14 can serve to read the bar-code information (i.e., the eighteen-digit number (or validation number)) of each designated bar-code ticket.

Thereafter, whether or not the paper sheet taken in the banknote handling machine 10 is the designated bar-code ticket is checked (see STEP 3 in FIG. 9A).

If the paper sheet taken in the banknote handling machine 10 is not determined as the designated bar-code ticket, whether or not this paper sheet taken in the banknote handling machine 10 is the banknote is further checked (see STEP 4 in FIG. 9A). If the paper sheet taken in the banknote handling machine 10 is the banknote, the recognition result on the denomination or the like of this banknote obtained by the recognition unit 14 is transmitted to the casino host computer 84, via the higher level terminal 82 (see STEP 5 in FIG. 9A). Then, this banknote will be stored in any one of the four stackers 16A, 16B, 16C, 16D (see STEP 6 in FIG. 9A). Meanwhile, if the paper sheet taken in the banknote handling machine 10 is not determined as any one of the designated bar-code ticket and banknote, this paper sheet (more particularly, the bar-code ticket other than the designated bar-code tickets) will be fed to either one of the reject units 15A, 15B (see STEP 8 in FIG. 9A).

If the paper sheet taken in the banknote handling machine 10 is determined as the designated bar-code ticket, the information on the fact that the designated bar-code ticket is taken in the banknote handling machine 10 will be transmitted to the casino host computer 84, via the higher level terminal 82 (see STEP 7 in FIG. 9A). Then, each recognition result on the plurality of batches of the paper sheets is separated by such a designated bar-code ticket. More specifically, when a certain banknote is handled by the banknote handling machine 10, the transaction information, with which the intrinsic information on the designated bar-code ticket that is handled by the banknote handling machine 10 after the certain banknote is associated, will be judged to be associated with the certain banknote, by the casino host computer 84. In this way, the information on the association between each recognition result on the banknotes and the transaction information can be obtained. Then, each designated bar-code ticket will be fed to either one of the reject units 15A, 15B (see STEP 8 in FIG. 9A).

Thereafter, whether or not the banknotes still remain in the take-in unit 11 is checked (see STEP 9 in FIG. 9A). If some paper sheets still remain in the take-in unit 11, the operations, as respectively described in the STEPs 1 through 8 respectively shown in FIG. 9A, will be repeated. Meanwhile, if the paper sheets no longer remain in the take-in unit 11, the handling operation for the plurality of batches of the paper sheets by the banknote handling machine 10 will be once ended.

Then, the stacked paper sheets of the rejected banknotes and bar-code tickets including designated bar-code tickets, respectively fed to the reject units 15A, 15B, are taken out from the reject units 15A, 15B, while the order of stacking such paper sheets is kept. Thereafter, the stacked paper sheets of the rejected banknotes and bar-code tickets including designated bar-code tickets, respectively taken out from the reject units 15A, 15B, will be handled by the bar-code ticket handling machine 20.

Namely, the stacked paper sheets of the rejected banknotes and bar-code tickets including designated bar-code tickets, respectively taken out from the reject units 15A, 15B of the banknote handling machine 10, are placed on the take-in unit 21 of the bar-code ticket handling machine 20. Then, the paper sheets included in such stacked paper sheets are taken, in succession, one by one, into the bar-code ticket handling machine 20 (see STEP 10 in FIG. 9B). If the paper sheet taken in the bar-code ticket handling machine 20 is the bar-code ticket, the bar-code information (i.e., the eighteen-digit number (or validation number)) of this bar-code ticket will be read by the recognition unit 24 (see STEP 11 in FIG. 9B). Then, the image of this bar-code ticket will be obtained by the image obtaining unit 27 (see STEP 12 in FIG. 9B). In this case, the bar-code ticket, whose bar-code information cannot be read by the recognition unit 24 (i.e., the rejected bar-code ticket), will be fed to the reject unit 25.

Then, the higher level terminal 82 judges whether or not the paper sheet taken in the bar-code ticket handling machine 20 is the designated bar-code ticket (see STEP 13 in FIG. 9B). If the paper sheet taken in the bar-code ticket handling machine 20 is determined as the designated bar-code ticket, whether or not the rejected bar-code tickets and/or rejected banknotes are present in the reject unit 25 is checked (see STEP 14 in FIG. 9B). If the rejected bar-code tickets and/or rejected banknotes are judged not to be present in the reject unit 25, the information on the fact that the designated bar-code ticket is taken in the bar-code ticket handling machine 20 will be transmitted to the casino host computer 84, via the higher level terminal 82 (see STEP 15 in FIG. 9B). Then, each recognition result on the plurality of batches of the paper sheets, respectively handled by the bar-code ticket handling machine 20, is separated, by such a designated bar-code ticket. More specifically, when a certain bar-code ticket is handled by the bar-code ticket handling machine 20, the transaction information, with which the intrinsic information on the designated bar-code ticket handled by the bar-code ticket handling machine 20 after the certain bar-code ticket is associated, will be judged to be associated with the certain bar-code ticket, by the casino host computer 84. In this way, the information on the association between each recognition result on the paper sheets and the transaction information can be obtained. Meanwhile, in the case the rejected bar-code tickets and/or rejected banknotes are judged to be present in the reject unit 25, the designated bar-code ticket will be fed to the reject unit 25 (see STEP 18 in FIG. 9B).

Meanwhile, if the paper sheet taken in the bar-code ticket handling machine 20 is not determined as the designated bar-code ticket, this paper sheet will be assigned as the bar-code ticket, and the bar-code information (i.e., the eighteen-digit number (or validation number)) of this bar-code ticket read by the recognition unit 24 as well as the image of the bar-code ticket obtained by the image obtaining unit 27 will be respectively transmitted to the casino host computer 84, via the higher level terminal 82 (see STEP 16 in FIG. 9B). Then, this bar-code ticket will be stored in either one of the two stackers 26A, 26B (see STEP 17 in FIG. 9B).

Thereafter, whether or not the paper sheets still remain in the take-in unit 21 is checked (see STEP 19 in FIG. 9B). If some paper sheets still remain in the take-in unit 21, the operations, as respectively described in the STEPs 10 through 18 respectively shown in FIG. 9B, will be repeated. Meanwhile, if the paper sheets no longer remain in the take-in unit 21, the handling operation for the plurality of batches of the paper sheets, by the bar-code ticket handling machine 20, will be ended.

As discussed above, various aspects of the method for handling the paper sheets by the paper sheet handling system as shown in FIG. 1 and other related drawings have been respectively described, with reference to the flow-charts respectively shown in FIGS. 4 through 9. However, it should be appreciated that the method for handling the paper sheets according to the present invention is not limited to such aspects as respectively illustrated by the flow charts respectively shown in FIGS. 4 through 9.

In the method for handling the paper sheets related to the embodiment of this invention, the paper sheet present at the uppermost or lowest part of each batch of the paper sheets is assigned as the designated paper sheet, while the intrinsic information on this designated paper sheet is associated with the transaction information corresponding to the batch of the paper sheets. In this case, the intrinsic information on the designated paper sheet is defined as the bar-code information (more specifically, the eighteen-digit number (or validation number)) of the bar-code ticket in the case the designated paper sheet is the bar-code ticket, or defined as the serial number of the banknote in the case the designated paper sheet is the banknote. Then, the plurality of batches of the paper sheets are stacked, one on another, in the number corresponding to the transactions, while the intrinsic information on each designated paper sheet is already associated with the transaction information. More specifically, the plurality of batches of the paper sheets are stacked, one on another, after being taken out, respectively, from the cassettes respectively provided to the slot machines 92. Thereafter, such stacked batches of the paper sheets are handled, collectively, by the paper sheet handling system. In this case, each recognition result on the plurality of batches of the paper sheets, respectively handled by the paper sheet handling system, is separated, by each designated paper sheet. In this way, the information on the association between each recognition result on the paper sheets and the transaction information can be obtained, while eliminating the need for further handling the used separator members after each handling operation for the paper sheets.

Thus, according to the method for handling the paper sheets related to this embodiment of the present invention, each recognition result on the plurality of batches of the paper sheets respectively handled by the paper sheets handling system can be separated, for the transaction information, without using any dedicated separator members, such as the header cards and/or separator cards. Therefore, the production cost required for the dedicated separator members can be eliminated. In addition, the need for providing such dedicated separator members to be fit for each handling mode for the paper sheets can be eliminated. As such, the information on the association between each recognition result on the paper sheets and the transaction information can be readily obtained.

In addition, when collectively handling the plurality of stacked batches of the paper sheets by the paper sheet handling system, as illustrated by the respective flow charts of FIGS. 4, 6, 8, the designated paper sheet of each batch of the paper sheets is first handled in the handling operation for the batch of the paper sheets. In this case, when a certain paper sheet is handled by the paper sheet handling system, the transaction information, with which the intrinsic information on the designated paper sheet that has been handled by the paper sheet handling system before the certain paper sheet is associated, will be judged to be associated with the certain paper sheet. Further, when collectively handling the plurality of stacked batches of the paper sheets by the paper sheet handling system, as described in each of the STEP 8 in FIG. 4, STEP 11 in FIG. 6, STEP 10 and STEP 18 in FIGS. 8A and 8B, and the like, the designated paper sheet of each batch of the paper sheets is fed to any one of the reject units 15A, 15B of the banknote handling machine 10 and/or reject unit 25 of the bar-code ticket handling machine 20.

Alternatively, when collectively handling the plurality of stacked batches of the paper sheets by the paper sheet handling system, as illustrated by the respective flow charts of FIGS. 5, 7, 9, the designated paper sheet of each batch of the paper sheets may be last handled in the handling operation for the batch of the paper sheets. In this case, when a certain paper sheet is handled by the paper sheet handling system, the transaction information, with which the intrinsic information on the designated paper sheet that is handled by the paper sheet handling system after the certain paper sheet is associated, will be judged to be associated with the certain paper sheet. Further, in this case, if there are some paper sheets, each determined as an abnormal paper sheet, among the paper sheets already taken in the banknote handling system, when collectively handling the plurality of stacked batches of the paper sheets by the paper sheet handling system, such paper sheets and the designated paper sheet that is handled after such paper sheets will be respectively fed to the reject unit (or units) of the paper sheet handling system (see the STEP 10 in FIG. 5, STEP 7 in FIG. 7, STEP 18 in FIG. 9B, and the like), while the other designated paper sheets will be stored in the stacker (or stackers) of the paper sheet handling system (see STEP 9 in FIG. 5, STEP 10 in FIG. 7, STEP 17 in FIG. 9B, and the like). According to this method for handling the paper sheets, if there is no rejected paper sheet (i.e., no rejected banknote and/or no rejected bar-code ticket) in the reject unit, each corresponding designated paper sheet can be directly stored in any one of the stackers, thus eliminating a need for further feeding this designated paper sheet to the reject unit, thereby achieving a more rapid handling operation for the paper sheets.

Further, as described above, in the case each batch of the paper sheets includes only the banknotes, the banknote present at the uppermost or lowest part of the batch of the banknotes may be assigned as the designated banknote, and when the intrinsic information on this designated banknote is associated with the transaction information corresponding to the batch of the banknotes, the serial number of this designated banknote may be associated with the transaction information. In this case, when associating the serial number of the designated banknote with the transaction information, the serial number of the designated banknote and the transaction information are respectively inputted to the paper sheet handling system. Thus, the casino host computer 84 of this paper sheet handling system can serve to associate the inputted serial number of the designated banknote with the inputted transaction information. Further, in this case, the banknote handling machine 10 is adapted for taking the banknotes, one by one, from the exterior to the interior thereof, recognizing each banknote taken therein, and then storing the banknotes, each determined as the normal banknote, in the stackers 16A, 16B, 16C, 16D, while feeding the banknotes, each determined as the abnormal banknote, to the reject units 15A, 15B.

Alternatively, as illustrated by the flow charts respectively shown in FIGS. 4, 5, and the like, in the case each batch of the paper sheets includes only the bar-code tickets, the bar-code ticket present at the uppermost or lowest part of the batch of the bar-code tickets may be assigned as the designated bar-code ticket, and when the intrinsic information on this designated bar-code ticket is associated with the transaction information corresponding to the batch of the bar-code ticket, the bar-code information on this designated bar-code ticket may be read to be associated with the transaction information. In this case, when associating the bar-code information on the designated bar-code ticket with the transaction information, the bar-code information on the designated bar-code ticket and the transaction information are respectively inputted to the paper sheet handling system. Thus, the casino host computer 84 of this paper sheet handling system can serve to associate the inputted bar-code information on the designated bar-code ticket with the inputted transaction information. Further, in this case, the bar-code ticket handling machine 20 is adapted for taking the bar-code tickets, one by one, from the exterior to the interior thereof, reading the bar-code information on each bar-code ticket taken therein, and then storing the bar-code tickets, each determined as the normal bar-code ticket, in the stackers 26A, 26B, while feeding the bar-code tickets, each determined as an abnormal bar-code ticket, to the reject units 25.

Further, in the case each batch of the paper sheets includes both the banknotes and bar-code tickets, in the mixed state, an arbitrary bar-code ticket included in this batch of the paper sheets may be moved to the uppermost or lowest of the batch of the paper sheets and then assigned as the designated bar-code ticket. In this case, the bar-code information on each designated bar-code ticket may be read to be associated with the transaction information corresponding to the batch of the paper sheets. Further, in this case, the banknote handling machine 10 or bar-code ticket handling machine 20 can serve to handle both the banknotes and bar-code tickets. As illustrated by the flow charts of FIGS. 6, 7, and the like, the bar-code ticket handling machine 20 (or banknote handling machine 10) is adapted for taking the paper sheets, one by one, from the exterior to the interior thereof, recognizing each paper sheet taken therein, and then storing the banknotes, each determined as the normal banknote, in one stacker (e.g., the stacker 26B) (see the STEP 9 in FIG. 6 and/or STEP 12 in FIG. 7), and storing the bar-code tickets, other than the designated bar-code tickets, in the other stacker (e.g., the stacker 26A) (see the STEP 7 in FIG. 6 and/or STEP 10 in FIG. 7), as well as feeding the banknotes, each determined as the abnormal banknote, to the reject unit 25, while feeding the bar-code tickets, each determined as the abnormal bar-code ticket, and the designated bar-code tickets to the reject unit 25 (see the STEP 11 in FIG. 6 and/or STEP 7 in FIG. 7).

Alternatively, when collectively handling the plurality of stacked batches of the paper sheets by the paper sheet handling system, as illustrated by the flow chart of FIGS. 8A and 8B, and the like, the plurality of batches of the paper sheets may be first handled collectively by the bar-code ticket handling machine 20, and then the paper sheets respectively fed to the reject unit 25 of the bar-code ticket handling machine 20 may be handled collectively by the banknote handling machine 10.

Alternatively, when collectively handling the plurality of stacked batches of the paper sheets by the paper sheet handling system, as illustrated by the flow charts of FIGS. 9A and 9B, and the like, the plurality of batches of the paper sheets may be first handled collectively by the banknote handling machine 10, and then the paper sheets respectively fed to the reject units 15A, 15B of the banknote handling machine 10 may be handled collectively by the bar-code ticket handling machine 20.

It should be noted that the method for handling the paper sheets according to the present invention is not limited to those aspects as described above, but various modifications and alterations can be made thereto. For instance, in the method for handling the paper sheets according to the present invention, the objects to be handled (i.e., the paper sheets) are not limited to the banknotes and/or bar-code tickets. Namely, this method can also be applied to the handling operation for any other suitable paper sheets, such as checks and the like.

The invention claimed is:

1. A method for handling paper sheets, comprising:

assigning a paper sheet present at the uppermost or lowest part of each batch of the paper sheets, as a designated paper sheet, while associating intrinsic information on the designated paper sheet with transaction information corresponding to the batch of the paper sheets;

stacking a plurality of batches of the paper sheets, one on another, in a number corresponding to transactions, the transaction information being associated with the intrinsic information on each designated paper sheet;

handling the stacked batches of the paper sheets, collectively, by using a paper sheet handling system; and separating each recognition result on the plurality of batches of the paper sheets, respectively handled by the paper sheet handling system, by each designated paper sheet, thereby to obtain information on the association between each recognition result on the paper sheets and the transaction information.

2. The method for handling the paper sheets, according to claim 1, wherein when collectively handling the plurality of stacked batches of the paper sheets by the paper sheet handling system, the designated paper sheet of each batch of the paper sheets is first handled in the handling operation for the batch of the paper sheets, and when a certain paper sheet is handled by the paper sheet handling system, the transaction information, with which the intrinsic information on the designated paper sheet that has been handled by the paper sheet handling system before the certain paper sheet is associated, is judged to be associated with the certain paper sheet.

3. The method for handling the paper sheets, according to claim 2, wherein when collectively handling the plurality of stacked batches of the paper sheets by the paper sheet handling system, the designated paper sheets of the respective batches of the paper sheets are respectively fed to a reject unit of the paper sheet handling system.

4. The method for handling the paper sheets, according to claim 3, wherein once the paper sheets are handled by the paper sheet handling system, a rejected paper sheet and designated paper sheets, respectively stacked one on another in the reject unit, are collectively handled again by the paper sheet handling system, while the order of stacking such paper sheets is kept, and then the designated paper sheets and the paper sheet that is capable of being handled during this handling operation are stored in a stacker of the paper sheet handling system, while the rejected paper sheet that is not capable of being handled is fed to the reject unit, and then the handling operation for the paper sheets, by the paper sheet handling system, is stopped.

5. The method for handling the paper sheets, according to claim 1, wherein when collectively handling the plurality of stacked batches of the paper sheets by the paper sheet handling system, the designated paper sheet of each batch of the paper sheets is last handled in the handling operation for the batch of the paper sheets, and when a certain paper sheet is handled by the paper sheet handling system, the transaction information, with which the intrinsic information on the designated paper sheet that is handled by the paper sheet handling system after the certain paper sheet is associated, is judged to be associated with the certain paper sheet.

6. The method for handling the paper sheets, according to claim 5, wherein when collectively handling the plurality of stacked batches of the paper sheets by using the paper sheet handling system, when some paper sheet, determined as an abnormal paper sheet, is included in the paper sheets respectively fed to the paper sheet handling system, such paper sheet, determined as the abnormal paper sheet, and the designated paper sheet that is handled after such paper sheet are respectively fed to the reject unit of the paper sheet handling system, while the other designated paper sheet is stored in the stacker of the paper sheet handling system.

7. The method for handling the paper sheets, according to claim 6, wherein once the paper sheets are handled by the paper sheet handling system, the rejected paper sheet and designated paper sheets, respectively stacked one on another in the reject unit, are collectively handled again by the paper sheet handling system, while the order of stacking such paper sheets is kept, and then the designated paper sheets and the paper sheet that is capable of being handled during this handling operation are stored in the stacker of the paper sheet handling system, while the rejected paper sheet that is not capable of being handled is fed to the reject unit, and then the handling operation for the paper sheets, by the paper sheet handling system, is stopped, once the designated paper sheet to be handled after such rejected paper sheet is handled.

8. The method for handling the paper sheets, according to claim 1, wherein the batches of the paper sheets consist of batches of the banknotes, and the banknote present at the uppermost or lowest part of each batch of the banknotes is assigned as a designated banknote, and the serial number of the designated banknote is associated with the transaction information corresponding to the batch of the banknotes, when associating the intrinsic information on the designated banknote with the transaction information.

9. The method for handling the paper sheets, according to claim 8, wherein when associating the serial number of the designated banknote with the transaction information, the serial number of the designated banknote and the transaction information are respectively inputted to the paper sheet handling system, and then a control unit of the paper sheet handling system associates the inputted serial number of the designated banknote with the inputted transaction information.

10. The method for handling the paper sheets, according to claim 8, wherein the paper sheet handling system includes a banknote handling machine, and the banknote handling machine is adapted for taking the banknotes, one by one, from the exterior to the interior thereof, recognizing each banknote taken therein, and then storing the banknote, determined as a normal banknote, in a stacker, while feeding the banknote, each determined as an abnormal banknote, to a reject unit.

11. The method for handling the paper sheets, according to claim 1, wherein the batches of the paper sheets consist of batches of the bar-code tickets, the bar-code ticket present at the uppermost or lowest part of each batch of the bar-code tickets is assigned as a designated bar-code ticket, and the bar-code information on this designated bar-code ticket is read and associated with the transaction information corresponding to the batch of the bar-code tickets, when associating the intrinsic information on the designated bar-code ticket with the transaction information.

12. The method for handling the paper sheets, according to claim 11, wherein when associating the bar-code information on the designated bar-code ticket with the transaction information, the bar-code information on the designated bar-code ticket and the transaction information are respectively inputted to the paper sheet handling system, and then the control unit of the paper sheet handling system associates the inputted bar-code information on the designated bar-code ticket with the inputted transaction information.

13. The method for handling the paper sheets, according to claim 11, wherein the paper sheet handling system includes a bar-code ticket handling machine, and the bar-code ticket handling machine is adapted for taking the bar-code tickets, one by one, from the exterior to the interior thereof, reading the bar-code information on each bar-code ticket taken therein, and then storing the bar-code ticket, determined as a normal bar-code ticket, in a stacker, while feeding the bar-code ticket, determined as an abnormal bar-code ticket, to a reject unit.

14. The method for handling the paper sheets, according to claim 1, wherein the batches of the paper sheets include both the banknotes and bar-code tickets, in a mixed state, one bar-code ticket included in each batch of the paper sheets is moved to the uppermost or lowest part of the batch of the paper sheets, before the plurality of the batches of the paper sheets are stacked, one on another, in the number corresponding to the transactions, and then the bar-code ticket moved to the uppermost or lowest part is assigned as the designated bar-code ticket, and the bar-code information on the designated bar-code ticket of each batch of the paper sheets is read, and then the so-read bar-code information is associated with the transaction information corresponding to the batch of the paper sheets.

15. The method for handling the paper sheets, according to claim 14, wherein the paper sheet handling system includes a paper sheet handling machine configured for handling both the banknotes and bar-code tickets;

the paper sheet handling machine is adapted for taking the paper sheets, one by one, from the exterior to the interior thereof, recognizing each paper sheet taken therein, and then storing the banknote, determined as the normal banknote, in one stacker, and storing the bar-code ticket, other than the designated bar-code ticket, in another stacker, as well as feeding the banknote, determined as the abnormal banknote, to the reject unit, while feeding the bar-code ticket, determined as the abnormal bar-code ticket, and the designated bar-code ticket to the reject unit.

16. The method for handling the paper sheets, according to claim 14, wherein the paper sheet handling system includes both the banknote handling machine and bar-code ticket handling machine, the banknote handling machine is adapted for taking the paper sheets, one by one, from the exterior to the interior thereof, recognizing each paper sheet taken therein, and then storing the banknote, determined as the normal banknote, in the stacker, while feeding the banknote, determined as the abnormal banknote, to the reject unit, as well as feeding the bar-code ticket to the reject unit, the bar-code ticket handling machine is adapted for taking the paper sheets, one by one, from the exterior to the interior thereof, reading the bar-code information on each bar-code ticket, among the paper sheets taken therein, and then storing the bar-code ticket, determined as the normal bar-code ticket, in the stacker, while feeding the bar-code ticket, determined as the abnormal bar-code ticket, and the designated bar-code ticket to the reject unit, as well as feeding the banknote to the reject unit, and when collectively handling the plurality of stacked batches of the paper sheets by the paper sheet handling system, the plurality of batches of the paper sheets are first handled collectively by the bar-code ticket handling machine, and then the paper sheets respectively fed to the reject unit of the bar-code ticket handling machine are handled collectively by the banknote handling machine.

17. The method for handling the paper sheets, according to claim 14, wherein the paper sheet handling system includes both the banknote handling machine and bar-code ticket handling machine, the banknote handling machine is adapted for taking the paper sheets, one by one, from the exterior to the interior thereof, recognizing each paper sheet taken therein, and then storing the banknote, determined as the normal banknote, in the stacker, while feeding the banknote, determined as the abnormal banknote, to the reject unit, as well as feeding the bar-code ticket to the reject unit, the bar-code ticket handling machine is adapted for taking the paper sheets, one by one, from the exterior to the interior thereof, reading the bar-code information on each bar-code ticket, among the paper sheets taken therein, and then storing the bar-code ticket, determined as the normal bar-code ticket, in the stacker, while feeding the bar-code ticket, determined as the abnormal bar-code ticket, and the designated bar-code ticket to the reject unit, as well as feeding the banknote to the reject unit, and when collectively handling the plurality of stacked batches of the paper sheets by the paper sheet handling system, the plurality of batches of the paper sheets are first handled collectively by the banknote handling machine, and then the paper sheets respectively fed to the reject unit of the banknote handling machine are handled collectively by the bar-code ticket handling machine.

* * * * *